US009405309B2

(12) United States Patent
Bîziitu et al.

(10) Patent No.: US 9,405,309 B2
(45) Date of Patent: Aug. 2, 2016

(54) DUAL MODE LOW-DROPOUT LINEAR REGULATOR

(71) Applicant: Infineon Technologies AG, Neubiberg (DE)

(72) Inventors: Florin Bîziitu, Bucharest (RO); Ansgar Pottbaecker, Grafing (DE); Paul David Patriche, Bucharest (RO)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 14/556,111

(22) Filed: Nov. 29, 2014

(65) Prior Publication Data

US 2016/0154415 A1 Jun. 2, 2016

(51) Int. Cl.
*G05F 1/575* (2006.01)

(52) U.S. Cl.
CPC ..... *G05F 1/575* (2013.01)

(58) Field of Classification Search
CPC ..... G05F 1/56; G05F 1/575
USPC ..... 323/266–272
See application file for complete search history.

(56) References Cited

U.S. PATENT DOCUMENTS 5,939,867 A * 8/1999 Capici ..... G05F 1/565 323/277
2006/0033481 A1* 2/2006 Thiele et al. ..... 323/266
2008/0116862 A1* 5/2008 Yang ..... G05F 1/575 323/269
2008/0191670 A1* 8/2008 Oddoart ..... G05F 1/565 323/273
2009/0195234 A1* 8/2009 Arnold ..... G05F 1/56 323/299
2012/0098508 A1* 4/2012 Zhu ..... G05F 1/56 323/272

OTHER PUBLICATIONS

"SBC Gen2 with CAN High Speed and LIN Interface," Freescale Semiconductor Technical Data Sheet, Document No. MC33903_4_5, Rev. 11.0, Aug. 2014, 106 pp.
"TLE8261E, Universal System Basis Chip, HERMES," Infineon Technologies Data Sheet, Rev. 1.0, Mar. 31, 2009, 82 pp.
"TLE8261-2E, Universal System Basis Chip, HERMES," Infineon Technologies Data Sheet, Rev. 1.0, May 26, 2009, 83 pp.
"UJA1075A, High-speed CAN/LIN core system basis chip," NXP Semiconductors Product Data Sheet, Rev. 02, Jan. 28, 2011, 54 pp.

* cited by examiner

*Primary Examiner* — Jue Zhang
(74) *Attorney, Agent, or Firm* — Shumaker & Sieffert, P.A.

(57) ABSTRACT

In one example, a method includes operating an LDO regulator system in one of a voltage regulation mode or a power balancing mode. The method further includes comparing one or more respective reference voltages to one or more respective feedback voltages to determine a change in amount of current that needs to be delivered by the LDO regulator system, wherein a first reference voltage is across a reference resistor and a first feedback voltage is across a shunt resistor, and in response to the change in the amount of current that needs to be delivered by the LDO regulator system, adjusting an amount of current flowing through a transistor to maintain a load at a constant output voltage level. Circuits and systems that implement the method are also described.

20 Claims, 7 Drawing Sheets

500

| | | |
|---|---|---|
| 502 | Input voltage range ($V_{BAT}$) | 4.5V - 28V for Vout=3.3V, 1.8V, 1.2V<br>5.5V -28V for Vout=5V |
| 504 | Typical quiescent current in low power mode | 40 uA (at 0 load current) |
| 506 | Low power mode output voltage precision | +/- 4% (at low load currents, active peak off) |
| 508 | High power mode output voltage precision | +/- 2% for Vout= 5V/3.3V<br>+/- 3% for Vout=1.8V/1.2V |
| 510 | Active peak rising threshold PNP base current | 50uA ( translating to 8.5 mA load current for PNP beta of 150) |
| 512 | Active peak falling threshold PNP base current | 30uA ( translating to 4.5 mA load current for PNP beta of 150) |
| 514 | Over-current Shunt Voltage Threshold | 245mV ( translating into 490 mA load current for 0.5Ohms Rshunt and 245 mA load current for 1Ohm Rshunt ) |
| 516 | Power balancing ratio I_PNP : I_LDO | 1:1 with 1 Ohm Rshunt<br>2:1 with 0.5 Ohms Rshunt |
| 518 | Maximum base current | 60 mA |
| 520 | Output capacitor | Voltage regulation mode: 4.7uF ceramic placed at the PNP collector<br>Power balancing mode: 10uF ceramic placed at the output pin of the integrated LDO regulator |

FIG. 6

DUAL MODE LOW-DROPOUT LINEAR REGULATOR

TECHNICAL FIELD

This disclosure is related to DC linear voltage regulators, and more particularly, to a low-dropout (LDO) regulator.

BACKGROUND

DC linear voltage regulators are designed to maintain an output voltage at a constant voltage level over a range of output impedance. If there is a change in the output or input (e.g., a change in the load driven by the voltage regulator or change in the source voltage), the voltage regulator corrects for the change to maintain the output voltage at the constant voltage level. For example, if there is a sudden change in the amount of current that needs to be delivered by the voltage regulator due to a change in the load impedance, the output voltage level of the voltage regulator may temporarily deviate from the constant output voltage level until the voltage regulator corrects for the change in the load impedance and outputs a voltage at the constant voltage level.

SUMMARY

In general, the disclosure describes systems, devices, and techniques to control a low drop-out (LDO) linear regulator with a transistor to operate in a voltage regulation mode or a power balancing mode. The LDO linear regulator acting as an over-current protected voltage controlled voltage source in the voltage regulation mode or as a current controlled current source in the power balancing mode. The techniques described in this disclosure may provide a high performance (e.g., low quiescent current and fast dynamic response) LDO linear regulator that may operate in a voltage regulation mode or a power balancing mode.

In one example, the disclosure is directed to a method comprising operating an LDO regulator system in one of a voltage regulation mode or a power balancing mode. The method of operating the LDO regulator system comprising comparing one or more respective reference voltages to one or more respective feedback voltages to determine a change in amount of current that needs to be delivered by the LDO regulator system, wherein a first reference voltage is across a reference resistor and a first feedback voltage is across a shunt resistor, and in response to the change in the amount of current that needs to be delivered by the LDO regulator system, adjusting an amount of current flowing through a transistor to maintain a load at a constant output voltage level.

In another example, the disclosure is directed to a low-dropout (LDO) regulator system comprising a transistor connected to a power source of a low-dropout (LDO) linear regulator and a load of the LDO linear regulator, wherein the transistor delivers an amount of current needed to maintain an output of the LDO linear regulator at a constant output voltage level, a shunt resistor connected in series with the transistor, a reference stage, wherein the reference stage includes a reference resistor connected to the power source of the LDO linear regulator and a current source connect to a ground, a first amplifier stage, wherein the first amplifier stage generates a first current proportional to a difference between a voltage drop across the shunt resistor and a reference voltage across the reference resistor, a second amplifier stage, wherein the second amplifier stage generates a second current proportional to a difference of a proportional output voltage and a second reference voltage, and an output buffer stage connected between a combined output of the first and second amplifier stages and a gate of the transistor, wherein the output buffer stage generates a control signal to control the transistor based on an output from the combined output, wherein the first amplifier stage in a voltage regulation mode is configured to sink the first current, wherein the first amplifier stage in a power balancing mode is configured to sink or source the first current, wherein the second amplifier stage in the voltage regulation mode is configured to sink or source the second current, and wherein the second amplifier stage in the power balancing mode is configured to isolate the second current from the combined output.

In another example, the disclosure is directed to a device comprising means for operating a LDO regulator system in a voltage regulation mode, and means for operating the LDO regulator system in a power balancing mode. The means for operating the LDO regulator system in the voltage regulation mode and the power balancing mode further comprises means for comparing one or more respective reference voltages to one or more respective feedback voltages to determine a change in amount of current that needs to be delivered by the LDO regulator system, wherein a first reference voltage is across a reference resistor and a first feedback voltage is across a shunt resistor, and in response to the change in the amount of current that needs to be delivered by the LDO regulator system, means for adjusting an amount of current flowing through a transistor to maintain a load at a constant output voltage level.

The details of one or more examples described in this disclosure are set forth in the accompanying drawings and the description below. Other features, objects, and advantages of the techniques will be apparent from the description and drawings, and from the claims.

BRIEF DESCRIPTION OF DRAWINGS

FIG. 6 is a table illustrating specifications of a LDO regulator system, in accordance with this disclosure.

DETAILED DESCRIPTION

Figure 1:
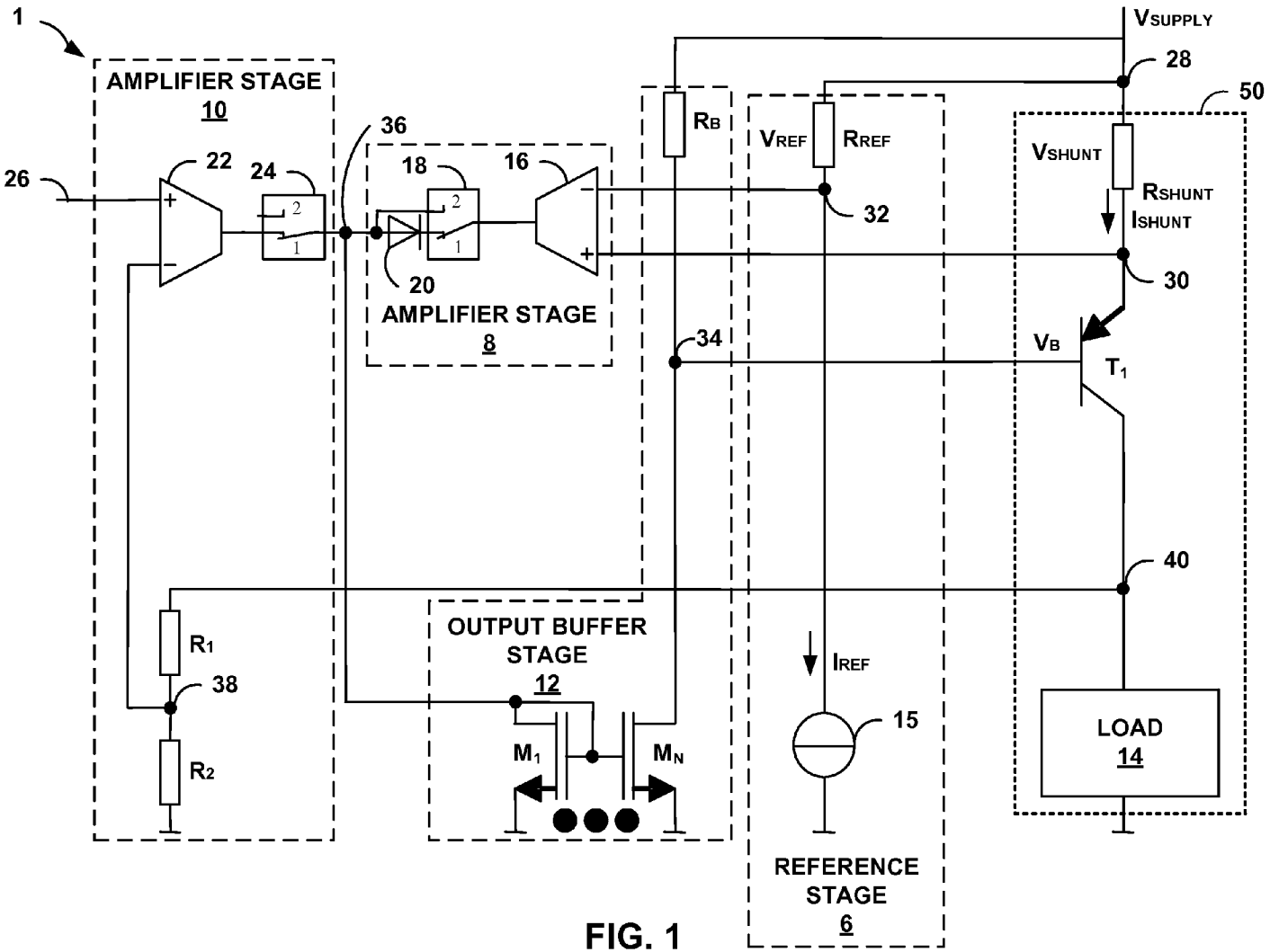
FIG. 1 is a conceptual block diagram illustrating an example LDO regulator system that operates in a voltage regulation mode or a power balancing mode, in accordance with the techniques described in this disclosure.

Techniques described in this disclosure are related to low-dropout (LDO) linear regulators (also described herein as "LDO regulator" or "LDO regulator system") that are configured to maintain a constant output voltage level over a range of load impedances. In some examples, the LDO regulator system may include two LDO regulators that operate separately in a voltage regulation mode of the LDO regulator system, or operate in parallel in a power balancing mode of the LDO regulator system. For ease of understanding, the operation of the LDO regulator with a transistor (e.g., an external PNP BJT or PFET device) that may include an off-chip portion (i.e., not "fully integrated on a chip") is described in voltage regulation mode, and the operations of both LDO regulators are described in power balancing mode. The LDO regulator system may receive as an input one or more reference voltages and one or more feedback voltages and output a current based on the one or more reference voltages and one or more feedback voltages.

In some examples, the amount of current that the LDO regulator system needs to deliver may change, and in some cases, suddenly change. For example, the LDO regulator system may be connected to a plurality of loads, and one of the loads may become disconnected causing a change in the amount of current the LDO regulator system needs to deliver. The change in the amount of current that the LDO regulator system needs to deliver may cause the output voltage to deviate from the constant output voltage level.

As described in more detail, the LDO regulator system includes two modes: a voltage regulation mode and a power balancing mode. In a voltage regulation mode, to stabilize the output voltage back to the constant output voltage level, the LDO regulator system may also receive the output voltage or a voltage proportional to the output voltage as a feedback voltage. The LDO regulator system may compare the feedback voltage with one of the one or more reference voltages and adjust currents of the LDO regulator system so that the output voltage stabilizes back to the constant output voltage level. In some examples, in voltage regulation mode, the LDO regulator system may autonomously adapt to the load condition by using two error amplifiers one for stand-by operation the other for active mode operation. In these examples, the LDO regulator system may not require a separate control mechanism or feedback loop to switch between low-power (stand-by) mode and high power (active) mode.

The time it takes the LDO regulator system to stabilize the output voltage back to the constant output voltage level is referred to as a transient response time. In general, it is preferable to stabilize to the output voltage back to the constant output voltage level relatively quickly (i.e., have a fast transient response time). As one example, a transient response time of less than 3 micro-seconds (μs) may be desirable. In some examples, in voltage regulation mode the transient response time may be 1 μs, and in power balancing mode the transient response time may be less than 3 μs. However, while a fast transient response time may be desirable, it may also be desirable to minimize the overshoot and the undershoot of the output voltage during the transient response time, as well as minimizing a quiescent current of the LDO regulator system and minimizing a size of a capacitor connected to the load.

In a power balancing mode, to increase the current capabilities of a separate fully integrated LDO regulator using a pass device (e.g., a MOSFET) on the same chip, the LDO regulator system may receive the voltage across the shunt resistor as a feedback voltage. The LDO regulator system may compare the feedback voltage with one of the one or more reference voltages and adjust currents of the LDO regulator system so that the output current of a transistor to the load mirrors the output current from the separate fully integrated LDO regulator to the load. In some examples, the ratio between the amount of current flowing through the pass device of the separate fully integrated LDO regulator and the amount of current flowing through the transistor may be programmed by resistance value of a shunt resistor.

In some examples, the load is connected to a capacitor, and the capacitor delivers the current during the transient response time. If the capacitance of the capacitor is relatively large, a longer transient response time can be tolerated because the capacitor will be able to deliver the current for a longer period of time as compared to if the capacitance of the capacitor is relatively small. However, capacitors with relatively large capacitance are generally larger in size, and having relatively large sized capacitors increases cost and utilizes additional area on the circuit board, which may be undesirable.

Quiescent current refers to the amount of current the LDO regulator system consumes when no load is connected to the LDO regulator system. For example, if the LDO regulator system is powered and no load is connected to the LDO regulator system, the amount of current that the LDO regulator system consumes is referred to as the quiescent current. The quiescent current may be relatively small (e.g., in the order of forty to sixty micro-amps (μA)). In other words, quiescent current is the amount of current the LDO regulator system consumes when the LDO regulator system is not delivering any current.

To reduce the transient response time, some techniques propose increasing the quiescent current. However, increasing the quiescent current may be undesirable because it may reduce the lifetime of the battery (e.g., the battery discharges more quickly having to deliver the higher quiescent current level).

This disclosure describes a LDO regulator that provides a fast transient response time, while operating in either a voltage regulation mode or a power balancing mode. In addition, this disclosure describes techniques for using an inexpensive external transistor, which does not require an increase in the quiescent current or an increase in the capacitance of the capacitor connected to the load.

FIG. 1 is a conceptual block diagram illustrating an example LDO regulator system 1 that operates in a voltage regulation mode or a power balancing mode, in accordance with the techniques described in this disclosure. For instance, FIG. 1 illustrates a LDO regulator system 1. As illustrated, LDO regulator system 1 includes reference stage 6, amplifier stages 8 and 10, output buffer stage 12, load 14, nodes 28-40, and off-chip stage 50. It should be understood that the grouping of reference stage 6, amplifier stages 8 and 10, and output buffer stage 12 is conceptual and illustrated for ease of understanding.

Shunt resistor ($R_{SHUNT}$) is an electrical component that exhibits electrical resistance in a circuit and provides a voltage ($V_{SHUNT}$) indicative of a current ($I_{SHUNT}$) through $R_{SHUNT}$. In some examples, in a voltage regulation mode, $R_{SHUNT}$ may provide a means of measuring the load current in order to implement a current limitation mechanism. In other examples, in a power-balancing mode, $I_{SHUNT}$ may be used to regulate the output current from a transistor (e.g., transistor T1). Transistor $T_1$ is an electrical component that outputs current to a load. Examples of transistor may include a PNP bipolar junction transistor (PNP), a p-channel field effect transistor (PFET), or any other electrical component that may output current to a load. In some examples, resistor $R_{SHUNT}$ in both voltage regulation and power balancing mode may be used to measure current $I_{SHUNT}$, and in power balancing mode may be used to provide $I_{SHUNT}$ as a feedback regarding the current of load 14.

Reference stage 6 includes reference resistor ($R_{REF}$) and current source 15. Resistor $R_{REF}$ is an electrical component that exhibits electrical resistance in a circuit and provides a voltage ($V_{REF}$) indicative of a current ($I_{REF}$) through $R_{REF}$. In some examples, $V_{REF}$ may be proportional to $V_{SHUNT}$ and provided to an amplifier stage. In these examples, $V_{REF}$ may be used to provide current limitation of the voltage regulation mode or may be an input to be regulated for the current control loop in the power balancing mode.

In some examples, $I_{REF}$ in combination with resistance values of $R_{REF}$ and $R_{SHUNT}$ may be used to regulate the output current from transistor T1. In some examples, current $I_{REF}$ in voltage regulation mode may be internal and may not proportional to the external load current. In other examples, current $I_{REF}$ in power balancing mode may be proportional to the total load current from transistor T1. In some examples, current $I_{REF}$ may set the current limitation in voltage regulation mode. In other examples, current $I_{REF}$ may set the regulation of the load current in the power balancing mode.

Current source 15 is an electronic circuit that delivers or absorbs an electric current. For example, current source 15 connected to $R_{REF}$ and ground may absorb $I_{REF}$.

Amplifier stage 8 includes amplifier 16, switch 18, and diode 20. Examples of amplifier 16 may include, but not limited to, a transconductance amplifier, a transresistance amplifier, an error amplifier, or any electronic component that outputs a voltage or current that is proportional to a difference between two voltages. Examples of switch 18 may include, but not limited to, transistors, such as metal-oxide-semiconductor field-effect-transistors (MOSFETs), bipolar junction transistors (BJTs), or any other electrical component that can break an electrical circuit between two different positions. Diode 20 is electronic component with asymmetric conductance, such that diode 20 has low resistance to current in one direction and high resistance to current in the opposite direction. It should be understood that switch 18 and diode 20 are conceptual and illustrated for ease of understanding.

In some examples, amplifier 16 may receive $V_{SHUNT}$ at its non-inverting input and $V_{REF}$ at its inverting input and output a first current ($I_1$) that is proportional to the difference between $V_{SHUNT}$ and $V_{REF}$. In some examples, switch 18 may receive $I_1$ from amplifier 16. In some examples, the two different positions of switch 18 may be a first position corresponding to a voltage regulation mode, and a second position corresponding to a power balancing mode. In these examples, when switch 18 is in the first position, diode 20 may be connected between the output of amplifier stage 8 and amplifier 16, such that amplifier stage 8 may only sink current. In these examples, amplifier 16 of amplifier stage 8 may have a first transconductance ($gm_1$) greater a second transconductance ($gm_2$) of the amplifier of amplifier stage 10. In other words, in voltage regulation mode, amplifier 16 of amplifier stage 8 may only sink current from the output of amplifier stage 8, allowing LDO regulator system 1 to limit the current provided by amplifier stage 10 in the voltage regulation mode to prevent overdriving the voltage control loop of LDO regulator system 1. In this manner, LDO regulator system 1 may act as current limited voltage controlled voltage source while operating in voltage regulation mode. In these examples, when switch 18 is in the second position, the output of amplifier 16 may be connected directly to the output of amplifier stage 8, such that amplifier stage 8 may sink or source current. In other words, in power balancing mode, amplifier 16 of amplifier stage 8 may sink or source current from the output of amplifier stage 8. In this manner, LDO regulator system 1 may act as a current controlled current source while operating in a power balancing mode.

Amplifier stage 10 includes amplifier 22, switch 24, resistors R1 and R2, and input 26. Examples of amplifier 22 may include, but not limited to, a transconductance amplifier, a transresistance amplifier, an error amplifier, or any electronic component that outputs a voltage or current that is proportional to a difference between two voltages. Examples of switch 24 may include, but not limited to, transistors, such as metal-oxide-semiconductor field-effect-transistors (MOSFETs), bipolar junction transistors (BJTs), or any other electrical component that can break an electrical circuit between two different positions. Resistors R1 and R2 are each an electrical component that exhibits electrical resistance in a circuit, and combine to form a voltage divider. For instance, resistors R1 and R2 divide the voltage across the load to provide a feedback voltage ($V_{FB}$) that is proportional to the voltage across the load. Input 26 is a second reference voltage ($V_{REF2}$) that is provided to the non-inverting input of amplifier 22.

In some examples, amplifier 22 may receive $V_{REF2}$ at its non-inverting input and $V_{FB}$ at its inverting input and output a second current ($I_2$) that is proportional to the difference between $V_{REF2}$ and $V_{FB}$. In some examples, switch 24 may receive a second current $I_2$ from amplifier 22. In some examples, the two different positions of switch 24 may be a first position corresponding to a voltage regulation mode, and a second position corresponding to a power balancing mode. In these examples, when switch 24 is in the first position, the output of amplifier 22 may be connected directly to the output of amplifier stage 10, such that amplifier stage 10 may sink or source current. In these examples, amplifier 22 of amplifier stage 10 may have a second transconductance ($gm_2$) lower than a first transconductance ($gm_1$) of amplifier 16 of amplifier stage 8. In other words, in voltage regulation mode, amplifier 22 of amplifier stage 10 may sink or source current from the output of amplifier stage 10, allowing LDO regulator system 1 to provide voltage regulation of a load, however, the current provided by amplifier 22 of amplifier stage 10 may be limited from sourcing current by amplifier 16 of amplifier stage 8. In this manner, LDO regulator system 1 may act as a current limited voltage controlled voltage source. In these examples, when switch 24 is in the second position, the output of amplifier 22 may be disconnected from the output of amplifier stage 10, such that amplifier stage 10 may not sink or source current from the output of amplifier stage 10. In other words, in power balancing mode, amplifier 22 of amplifier stage 10 may be disconnected from the output of amplifier stage 10. In this manner, LDO regulator system 1 may act as a current controlled current source while operating in a power balancing mode.

Output buffer stage 12 includes transistors M1-MN and a bias resistor ($R_B$), where resistor $R_B$ is connected to the drain of transistor MN. In some examples, resistor $R_B$ may enable output buffer stage 12 to provide either a current or voltage output at the gate of transistor T1 because a particular current is being pulled from the supply and a particular voltage drop is resistor $R_B$. For example, resistor $R_B$ may allow LDO regulator system 1 to provide by output buffer stage 12, a current control signal to drive a PNP bipolar junction transistor, or a voltage control signal to drive a p-channel field effect transistor.

Transistors M1-MN form a current mirror, which may amplify the current received from a combined output of amplifier stages 8 and 10 by 1 to N. Examples of transistors M1-MN may include transistors such as, but not limited to, metal-oxide-semiconductor field-effect-transistors (MOSFETs), bipolar junction transistors (BJTs) or double-diffused metal-oxide-semiconductor field effect transistor (DMOS).

Load 14 receives the electrical power (e.g., voltage, current, etc.) provided by LDO regulator system 1, in some examples, to perform a function. Examples of load 14 may include, but are not limited to, computing devices and related components, such as microprocessors, electrical components, circuits, laptop computers, desktop computers, tablet computers, mobile phones, batteries, speakers, lighting units, automotive/marine/aerospace/train related components, motors, transformers, or any other type of electrical device and/or circuitry that receives a voltage or a current from a LDO regulator. In some examples, load 14 may include a capacitor and resistor connected in parallel to ground, such that the capacitor filters the output voltage.

Nodes 28-40 may comprise circuit nodes between electrical components in LDO regulator system 1, where electrical energy is passed to another electrical component. Node 28 may comprise a circuit node between a power source and the source/emitter of transistor T1 that connects resistor $R_{REF}$ and current source 15 in parallel with resistor $R_{SHUNT}$, transistor T1, and load 14. Node 30 may be a circuit node between resistor $R_{SHUNT}$ and transistor T1 that provides voltage $V_{SHUNT}$ to the non-inverting input of amplifier 16 of amplifier stage 8. Node 32 may be a circuit node between resistor $R_{REF}$ and current source 15 that provides voltage $V_{REF}$ to the inverting input of amplifier 16 of amplifier stage 8. Node 34 may comprise a circuit node between resistor $R_B$, the base of transistor T1, and the drain of transistor MN that provides either a control voltage across the gate of transistor T1 (e.g., transistor T1 is a PFET) or a current from the base of transistor T1 to the drain of transistor MN (e.g., transistor T1 is a PNP). For instance, when transistor T1 is a PNP device, then node 34 provides a current to the drain of transistor MN, and the current is regulated by LDO regulator system 1. In another instance, when transistor T1 is a PFET device, then node 34 provides a voltage across the gate of transistor T1, and the voltage is regulated by LDO regulator system 1. Node 36 may be a circuit node between the outputs of amplifier stages 8 and 10 that forms a combined output, which may provide a current to output buffer stage 12. For instance, in voltage regulation mode, current at node 36 may be sunk by amplifier stage 8 and sourced or sunk by amplifier stage 10, such that LDO regulator system 1 acts as a current limited voltage controlled voltage source. In another instance, in power balancing mode, current at node 36 may be sourced our sunk by amplifier stage 8, such that LDO regulator system 1 acts as a current controlled current source. Node 38 may be a circuit node between resistors R1 and R2 and the inverting input of amplifier 22, and node 38 provides a feedback voltage proportional to the output voltage across load 14. Node 40 may be a circuit node between load 14, the drain/collector of transistor T1, and resistor R1 that connects resistors R1 and R2 in parallel with load 14. In this manner, node 40 allows the output voltage across load 14 to be across the voltage divider formed by resistors R1 and R2.

Portions of LDO regulator system 1 may be formed within an integrated circuit (IC) and may function to provide a voltage output at a constant output voltage level. For example, reference stage 6, amplifier stages 8 and 10, and output buffer stage 12 may be formed within an IC. In this example, shunt resistor ($R_{SHUNT}$), transistor T1, and load 14 may be external to the IC forming off-chip stage 50. In some examples, the fast response time of LDO regulator system 1 may be obtained by having the dominant pole in the transfer function of LDO regulator system 1 working in voltage regulation mode set by the external capacitance that may be present in parallel with the load. In this way, by having the dominant pole set by external components all the internal poles can be set to higher frequencies ensuring a higher overall bandwidth and implicitly a better response time.

Voltage regulation mode and power balancing mode of LDO regulator system 1 may be utilized in various applications. As one example, LDO regulator system 1 may be utilized in automotive applications; however, LDO regulator system 1 may be used in other applications as well, and the techniques described in this disclosure are not limited to automotive applications. In general, LDO regulator system 1 may be used in any application where a constant, steady voltage level is needed or where additional current capability is needed.

In the example of FIG. 1, the source/emitter node of transistor T1 may be connected to a power source (e.g., $V_{SUPPLY}$) such as a battery and the drain/collector node of transistor T1 may be connected to an output of LDO regulator system 1, such as load 14.

In one example implementation of the voltage mode regulation, switches 18 and 24 are in a first position and transistor T1 may output the needed current to maintain the output voltage across load 14 at a constant output voltage level. The constant output voltage level of LDO regulator system 1 may be set by a second reference voltage (e.g., $V_{REF2}$) at input 26 of LDO regulator system 1. As described in more detail, LDO regulator system 1 may act as a current limited voltage controlled voltage source.

In one example of a current limited voltage controlled voltage source, LDO regulator system 1 may use transistor T1 to provide voltage regulation of load 14. LDO regulator system 1 may provide voltage $V_{SHUNT}$ to a non-inverting input of amplifier 16, and $V_{REF}$ to an inverting input of amplifier 16. Amplifier 16 may determine the difference between voltages $V_{SHUNT}$ and $V_{REF}$ and output a first current ($I_1$) proportional to the difference between voltages $V_{SHUNT}$ and $V_{REF}$ to switch 18. However, diode 20 may prevent amplifier 16 from sourcing current $I_1$ to node 36. For example, when $V_{REF}$ is greater than $V_{SHUNT}$, diode 20 prevents amplifier 16 from sourcing current $I_1$ to node 36. Instead, diode 20 may only allow amplifier 16 to sink current $I_1$ from node 36. For example, when $V_{SHUNT}$ is greater than $V_{REF}$, amplifier 16 may sink current $I_1$ from node 36.

LDO regulator system 1 may also provide from the voltage divider formed by resistors R1 and R2 of amplifier stage 10, a feedback voltage (e.g., $V_{FB}$) that is proportional to the output voltage, to the inverting input of amplifier 22. Amplifier 22 of amplifier stage 10 may receive voltage $V_{REF2}$ at the non-inverting input of amplifier 22, and determine the difference between voltages $V_{FB}$ and $V_{REF2}$. Amplifier 22 of amplifier stage 10 may output a second current ($I_2$) proportional to the difference between voltages $V_{FB}$ and $V_{REF2}$ to node 36 that is received by output buffer stage 12.

Output buffer stage 12 may receive current from node 36 and based on the received current provide a control signal that drives transistor T1 to increase or decrease the current output of transistor T1. For example, output buffer stage 12 may adjust the current that drives transistor T1 (e.g., a PNP device) to increase or decrease the current output of transistor T1. In another example, when $V_{REF}$ is greater than $V_{SHUNT}$, output buffer stage 12 in combination with resistor $R_B$ may adjust the voltage that drives transistor T1 (e.g., a PFET device) to increase or decrease the current output of transistor T1.

Additionally, when switch 18 is in the first position and $V_{SHUNT}$ is greater than $V_{REF}$ because the transconductance of amplifier 16 ($G_{m1}$) is greater than the transconductance of amplifier 22 ($G_{m2}$), LDO regulator system 1 may also limit the current through transistor T1. For example, when $I_{SHUNT}$ is greater than $I_{REF}$ multiplied by $R_{REF}$ and divided by $R_{SHUNT}$, which is shown as Equation 1, then the load current of transistor T1 may be limited.

$$I_{SHUNT} > \frac{I_{REF} \times R_{REF}}{R_{SHUNT}} \quad (1)$$

According to Equation 1, when $V_{REF}$ is greater than or equal to voltage $V_{SHUNT}$, current $I_2$ from amplifier stage 10 may not be influenced by current $I_1$ of amplifier stage 8 because of diode 20. However, when $V_{SHUNT}$ is greater than voltage $V_{REF}$, current $I_2$ from amplifier stage 10 may be overwritten by the sinking current $I_1$ of amplifier stage 8. In this manner, the voltage output may be equal to the constant output voltage level set by $V_{REF2}$, but LDO regulator system 1 may be limited from being overdriven as a voltage controlled voltage source.

In one example of a current controlled current source, LDO regulator system 1 may use transistor T1 as a current mirror to provide additional current to a separate fully integrated LDO. In other words, LDO regulator system 1 in power balancing mode may act as a current controlled current source and may use transistor T1 to increase the current capability of another fully integrated LDO. Transistor T1 may be referred to as a pass device or a pass element.

LDO regulator system 1 may provide voltage $V_{SHUNT}$ to a non-inverting input of amplifier 16, and $V_{REF}$ to an inverting input of amplifier 16. Amplifier 16 may determine the difference between voltages $V_{SHUNT}$ and $V_{REF}$ and output a first current ($I_1$) proportional to the difference between voltages $V_{SHUNT}$ and $V_{REF}$ to node 36 through switch 18 in a second position. For example, when $V_{REF}$ is greater than $V_{SHUNT}$, amplifier 16 may be configured to source current $I_1$ to node 36. In this example, when $V_{SHUNT}$ is greater than $V_{REF}$, amplifier 16 may be configured to sink current $I_1$ from node 36. In this example implementation, LDO regulator system 1, when switch 24 is in a second position, may also be configured to disconnect (e.g., turn-off) amplifier 22 of amplifier stage 10 from node 36.

Output buffer stage 12 may receive current from node 36 and based on the received current provide a control signal that drives transistor T1 to increase or decrease the load current of transistor T1. For example, $I_{SHUNT}$ may be limited to be equal to $I_{REF}$ multiplied by $R_{REF}$ and divided by $R_{SHUNT}$, which is shown as Equation 2. In this example, output buffer stage 12 may adjust the current that drives transistor T1 (e.g., a PNP device) to increase or decrease the load current of transistor T1 based on Equation 2. In another example, output buffer stage 12 in combination with resistor $R_B$ may adjust the voltage that drives transistor T1 (e.g., a PFET device) to increase or decrease the load current of transistor T1 based on Equation 2.

$$I_{SHUNT} = \frac{I_{REF} \times R_{REF}}{R_{SHUNT}} \quad (2)$$

In this manner, the current output may be equal to the constant output current level set by $V_{REF}$. Additionally, LDO regulator system 1 may be configured to mirror (e.g., replicate) the current output of a fully integrated LDO that is separate from LDO regulator system 1, which may provide increased current capability for powering load 14.

In the power balancing mode, LDO regulator system 1 may include a separate fully integrated LDO regulator, which may be seen as one unified power supply having the output voltage precision of the separate fully integrated LDO regulator. In some examples, transistor T1 (e.g., an external PNP BJT or PFET) may be working in parallel with the pass device (e.g., MOSFET) of the separate fully integrated LDO regulator. In some examples, in the power balancing mode, the separate fully integrated LDO regulator may be responsible for voltage regulation of load 14, and the rest of LDO regulator system 1 may maintain the power balance ratio between the pass device of the separate fully integrated LDO regulator and transistor T1 (e.g., an external PNP BJT or PFET).

In this manner, in the voltage regulation mode, LDO regulator system 1 may use a higher power-rated PNP device as transistor T1 while also using the other separate fully integrated LDO regulator as a separate regulator (i.e., two separate LDO regulators). In this manner, in the power balancing mode, LDO regulator system 1 may extend the load specifications of the separate fully integrated LDO regulator using transistor T1 (e.g., PNP BJT or PFET device).

In the power balancing mode, the current ratio of transistor T1 (e.g., an external PNP BJT or PFET pass element) and the separate fully integrated LDO regulator may be set by the resistance value of resistor $R_{SHUNT}$, and as a consequence the over-current limitation function of LDO regulator system 1 may rely on the over current limitation function of a separate fully integrated LDO. Since the voltage drop across transistor T1 (e.g., an external PNP BJT or PFET pass element) and across the internal pass element of the separate fully integrated LDO may be identical, the current ratio may also set the ratio of the power dissipated at both the internal pass-element and transistor T1, that is, "power balancing mode."

In some examples, the internal pass element and transistor T1 may have thermal coupling (e.g. the pass element is in close proximity to the transistor), the thermal protection of the separate fully integrated LDO regulator may also thermally protect transistor T1 (e.g., an external PNP BJT or PFET), which may thermally protect LDO regulator system 1. In some examples, depending on the thermal impedance of the printed circuit board (PCB) on which the external pass device and the integrated circuit (e.g., LDO system 1 and the separate fully integrated LDO) are mounted on, a distance of a few cm may be acceptable for optimal thermal coupling. However, it is contemplated that the distance for acceptable thermal coupling may vary by each application of LDO regulator system 1. In these examples, the thermal protection of the separate fully integrated LDO regulator may allow for a significant reduction in the guard-band of the current level of transistor T1 (e.g., an external PNP BJT or PFET), which would otherwise be needed for thermal protection.

One of the capabilities of LDO regulator system 1 may be to switch between first and second modes, where the first mode corresponds to voltage regulation of load 14 and the second mode corresponds to power balancing (e.g., supplying additional current) load 14 with another integrated LDO.

Another of the capabilities of LDO regulator system 1 may be to withstand changes (e.g., perturbations or transients) at the output or input of LDO regulator system 1 from different sources. For example, parameters such as transient load regulation and transient line regulation define the ability of LDO regulator system 1 to withstand changes at the output or input. Transient line regulation defines the ability of LDO regulator system 1 to maintain the output voltage at the constant output voltage level even if there is a change in the source voltage. For instance, as described above, the source/emitter node of transistor T1 is connected to a power source such as a battery. If there is a sudden change in the voltage from the power source (i.e., a line transient), it may be possible that the change in the voltage from the power source causes the output voltage to deviate from the constant output voltage level. The ability of LDO regulator system 1 to maintain the output voltage at the constant output voltage level is referred to the transient line regulation.

Transient load regulation generally refers to the ability of LDO regulator system 1 to maintain the output voltage at the constant output voltage level due to a change (e.g., sudden change) in load 14 driven by LDO regulator system 1. For example, if there is a sudden change in the impedance of the load driven by LDO regulator system 1, the output voltage of LDO regulator system 1 may deviate from the constant output voltage level.

The transient load regulation may also refer to the ability of LDO regulator system 1 to adjust the current that needs to be outputted to maintain the output voltage at the constant output voltage level. One unit of measurement for the transient load regulation of LDO regulator system 1 is the transient response time. The transient response time may be a measure of the amount of time LDO regulator system 1 takes to adjust the current, due to a change in the load, to maintain the output voltage at the constant output voltage level. As described above, it may be preferable to minimize the transient response time.

Quiescent current may generally refer to the current that LDO regulator system 1 consumes when LDO regulator system 1 is not delivering current. In some examples, $I_{SHUNT}$ and $I_{REF}$ currents are part of the quiescent current of LDO regulator system 1. Increasing the quiescent current is undesirable because the increased quiescent current may drain the battery that powers LDO regulator system 1 more quickly. In other words, high current efficiency is needed to maximize the lifetime of the battery that is supplying LDO regulator system 1 with power.

Some other techniques propose, in addition to or instead of increasing the quiescent current, to increase a size of a capacitor connected to an output of LDO regulator system 1. The output of LDO regulator system 1 may be connected to a capacitor. The capacitor may function as a tank to provide the needed current until the feedback loop of LDO regulator system 1 is able to react (e.g., the feedback voltage causes an adjustment in the current flowing to the load).

The length of time the capacitor can provide the needed current may be a function of the amount of capacitance that the capacitor provides. For instance, a capacitor with higher capacitance can provided the needed current longer than a capacitor with lower capacitance. To make a system more tolerable to a slower transient response time, it may be possible to connect a capacitor with a relatively large capacitance so that the capacitor can deliver the needed current for a longer period of time.

However, capacitors with higher capacitance are generally larger in size than capacitors with lower capacitance and tend to cost more as well. Having a larger sized capacitor may require additional area on a printed circuit board (PCB) that includes LDO regulator system 1. Also, having the larger size capacitor may increase cost.

Figure 2:
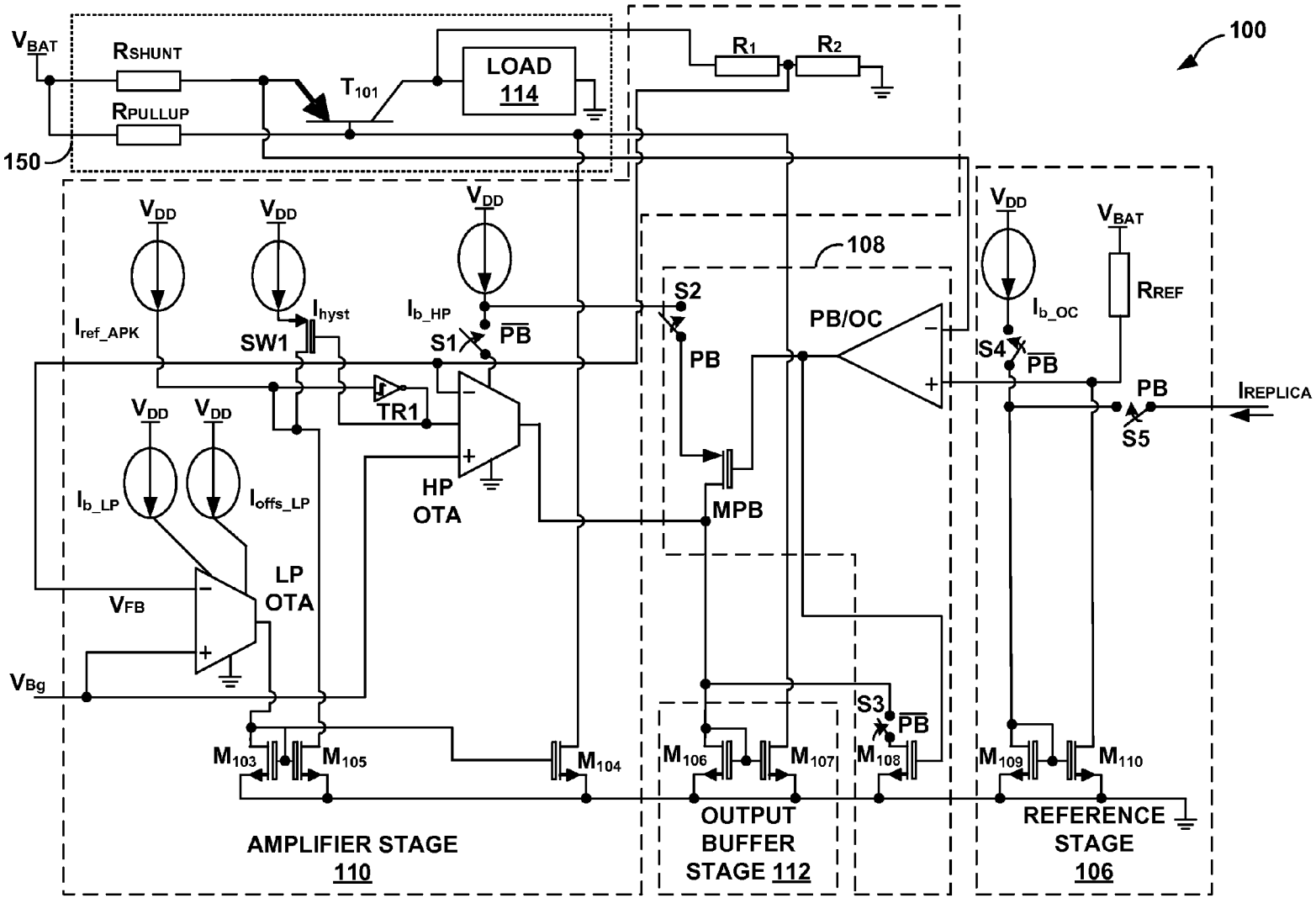
FIG. 2 is a circuit diagram illustrating a more detailed example of a LDO regulator system, in accordance with the techniques described in this disclosure.

FIG. 2 is a circuit diagram illustrating a more detailed example of a LDO regulator system 100, in accordance with the techniques described in this disclosure. FIG. 2 is described with reference to FIG. 1. In the example of FIG. 2, resistors $R_{SHUNT}$, $R_{REF}$, R1, and R2, transistor T101, reference stage 106, amplifier stages 108 and 110, output buffer stage 112, and load 114 may correspond to resistor $R_{SHUNT}$, $R_{REF}$, R1, and R2, transistor T1, reference stage 6, amplifier stages 8 and 10, output buffer stage 12, and load 14 as described in FIG. 1. Although LDO regulator system 100 illustrated in FIG. 2 is generally described as operating in the voltage regulation mode, LDO regulator system 100 may also operate in a power balancing mode as described in FIG. 3.

In the example of FIG. 2, LDO regulator system 100 includes voltages $V_{BAT}$, $V_{Bg}$, $V_{DD}$, and $V_{FB}$, currents $I_{REPLICA}$, $I_{REF_APK}$, $I_{hyst}$, $I_{b_HP}$, $I_{b_OC}$, $I_{b_LP}$, $I_{offs_LP}$, transistors M103-M110, and MPB, switches S1-S5, and SW1, error amplifiers LP OTA, HP OTA, and PB/OC, Schmitt trigger TR1, resistor $R_{PULLUP}$, and off-chip stage 150.

Voltage $V_{BAT}$ may correspond to $V_{SUPPLY}$ as described in FIG. 1. In some examples, $V_{BAT}$ may be a voltage from a battery. Voltage $V_{Bg}$ may correspond to $V_{REF2}$ as described in FIG. 1. In some examples, $V_{Bg}$ may be a voltage from an on-chip band gap voltage reference. Voltage $V_{DD}$ may correspond to $V_{SUPPLY}$ as described in FIG. 1. In some examples, $V_{DD}$ may be an on-chip supply voltage. Voltage $V_{FB}$ may correspond to the second feedback voltage as described in FIG. 1 (e.g., voltage in node 38 as described in FIG. 1). In some examples, $V_{FB}$ may be a feedback voltage from a voltage divider formed by resistors R1 and R2, and $V_{FB}$ may be proportional to the output voltage across load 114.

Current $I_{REPLICA}$ is a current provided from an optional separate integrated LDO linear regulator (not shown). In some examples, $I_{REPLICA}$ may be a current directly proportional to the amount of current provided by the separate integrated LDO linear regulator to load 114. In these examples, $I_{REPLICA}$ is only received when LDO regulator system 100 is operating in the power balancing mode. Current $I_{REF_APK}$ is a current provided from a current source. In some examples, $I_{REF_APK}$ may be the amount of current that in combination with the drain current of transistor M105 (set by the ratio between the sizes of transistors M103 and M105) defines the rising (low to high power) and falling (high to low power) active peak thresholds (the transition points in the load/PNP base current). Current $I_{hyst}$ is a current provided from a current source. In some examples, $I_{hyst}$ may be the amount of current that defines the hysteresis between the rising and falling thresholds. Current $I_{b_LP}$ may be a current provided from a current source. In some examples, $I_{b_LP}$ may be the amount of current that is used for biasing the low power error amplifier LP OTA. Current $I_{offs_LP}$ may be a current provided from a current source. In some examples, $I_{offs_LP}$ may be the amount of current that defines the offset needed to set the low power regulation point higher by de-balancing error amplifier LP_OTA. In other examples, to set the low power regulation point higher, the inverting input of error amplifier LP_OTA may be connected to another tap of a slightly lower potential in the feedback resistor divider of the regulator. Current $I_{B_HP}$ is a current provided from a current source. In some examples, in voltage regulation mode, $I_{B_HP}$ may be the amount of current that biases high power error amplifier HP_OTA. In some examples, in power balancing mode, $I_{B_HP}$ may be regulated by transistor MPB and injected into the same base driving current mirror (e.g., output buffer stage 112) used by error amplifier HP_OTA in voltage regulation mode based on the output of error amplifier PB/OC. Current $I_{b_OC}$ may be a current provided from a current source in the voltage regulation mode. In some examples, $I_{b_OC}$ may be the amount of current that biases resistor RPB to provide a first reference voltage, which enables error amplifier PB/OC to have an over-current limitation function.

Transistors M103-M110 may be medium or high voltage compliant N-type MOSFETS. In some examples, transistor pairs M103 and M104, M106 and M107, and M109 and M110 may each form a current mirror. Transistors M103 and M104 may form a current mirror which may be used as the actual output buffer for error amplifier LP OTA. Transistor M105 may be part of the current mirror formed by M103 and M104. In some examples, transistor M105 may provide a means to sense the load current of the regulator (e.g., by sensing the base current of the PNP) in order to determine the active peak threshold (e.g., the switching point between the low power and high power modes of LDO regulator system 100). Transistors M106 and M107 may form a second current mirror as output buffer 112, which may correspond to output buffer stage 12 as described in FIG. 1. Transistors M109 and M110 may form a third current mirror which may correspond to current source 15 as described in FIG. 1. In some examples, when LDO regulator system 100 is operating in voltage regulation mode, current $I_{REF}$ (e.g., drain current of transistor M110) may be a copy of the amount of current provided by current $I_{b_OC}$. In some examples, when LDO regulator system 100 is operating in power balancing mode, current $I_{REF}$ may be proportional to $I_{REPLICA}$ (e.g., current $I_{REPLICA}$ received from the fully integrated LDO) and may be closely following $I_{REPLICA}$ variations.

Transistor MPB may comprise a medium or high voltage compliant P-type MOSFETS. In some examples, in power balancing mode, transistor MPB regulates the current provided by the $I_{b_HP}$ current source, which is injected into output buffer stage 112. In these examples, the gate of transistor MPB is connected to the output of error amplifier PB/OC.

Switches S1-S5 may comprise any circuit element that is capable of breaking current flowing between various components in response to receiving a control input. Switch S1 is closed in voltage regulation mode and open in power balancing mode. Switch S2 is closed in power balancing mode and open in voltage regulation mode. Switch S3 is closed in voltage regulation mode and open in power balancing mode. Switch S4 is closed in voltage regulation mode and open in power balancing mode. Switch S5 is closed in power balancing mode and open in voltage regulation mode. Switch SW1 is a transistor that is capable of breaking current from the current source providing $I_{hyst}$. Switch SW1 may be a switch that is used in the implementation of the hysteresis mechanism. SW1 together with currents $I_{REF_apk}$ and $I_{hyst}$, transistor M105 and Schmitt trigger TR1 may form the active peak comparator, which may determine when to switch from low power mode to high power mode during voltage regulator operation of LDO regulator system 100. Switch SW1 may be on when the LDO regulator system 100 is operating in voltage regulation mode when the active peak signal is not asserted. As soon as the active peak signal is asserted, SW1 may turn off, breaking off the injected current $I_{hyst}$. Switch SW1 may be open in power balancing mode.

In some examples, when LDO regulator system 100 is operating in power balancing mode, error amplifier LP OTA as well as currents $I_{b_LP}$, $I_{offs_LP}$, $I_{REF_APK}$ and $I_{hyst}$ are switched off. In some examples, when LDO regulator system 100 is operating in power balancing mode, error amplifier HP OTA may also be implicitly switched off because biasing current $I_{b_HP}$ of error amplifier HP OTA may be routed through the closed switch S2.

Schmitt trigger TR1 may comprise a comparator circuit with hysteresis, which turns on the HP error amplifier by driving its enable signal. Schmitt trigger TR1 converts an analog input signal to a digital output signal, and the output signal retains its value until the input changes enough to trigger a change in the output signal. For example, the output signal of Schmitt trigger TR1 is high when the input is above a high threshold and low when the input is below a low threshold. In this example, the output signal of Schmitt trigger TR1 retains the high or low value until the input crosses one of the two thresholds.

Resistor $R_{PULLUP}$ may correspond to resistor $R_B$ as described in FIG. 1. For example, resistor $R_{PULLUP}$ may allow LDO regulator system 100 to provide a current control signal to drive a PNP bipolar junction transistor, or a voltage control signal to drive a p-channel field effect transistor.

Error amplifier PB/OC may correspond to amplifier 16 as described in FIG. 1, which is active during both voltage regulation mode and power balancing mode of LDO regulator system 100. In some examples, error amplifier PB/OC may be a differential amplifier, which amplifies a difference between two voltages. For example, error amplifier PB/OC may amplify the difference between the voltage across resistor $R_{SHUNT}$ (e.g., $V_{SHUNT}$ as described in FIG. 1) and the voltage across resistor $R_{REF}$ (e.g., $V_{REF}$ as described in FIG. 1). In some examples, during voltage regulation mode, error amplifier PB/OC may be used to provide an over-current limitation function. For instance, error amplifier PB/OC may compare the voltage drop generated on the $R_{REF}$ resistor by $I_{b_OC}$ biasing current source to the voltage drop on the external shunt resistor which is proportional to the load current sourced by the regulator. In this manner, the error signal generated by error amplifier PB/OC may control the gate of transistor M108 which starts sinking current directly from transistor MPB as soon as the over-current threshold is reached to limit the output from output buffer stage 112.

Error amplifier LP OTA may be one part of amplifier 22 as described in FIG. 1, which is only active during voltage regulation of mode of LDO regulator system 100. In some examples, error amplifier LP OTA may be a low power operational transconductance amplifier, which outputs a current proportional to the difference between two input voltages. For example, error amplifier LP OTA may output a second current proportional to the difference between $V_{Bg}$ and $V_{FB}$. Error amplifier HP OTA may be a second part of amplifier 22 as described in FIG. 1, which is only active during voltage regulation of mode of LDO regulator system 100. In some examples, error amplifier HP OTA may be a high power operational transconductance amplifier, which outputs a current proportional to the difference between two input voltages. For example, error amplifier HP OTA may output a third current proportional to the difference between $V_{Bg}$ and $V_{FB}$. In some examples, the second and third currents from error amplifiers LP OTA and HP OTA may combine to create a fourth current.

Off-chip stage 150 may include resistor $R_{SHUNT}$, transistor T101, and load 114. In some examples, off-chip stage 150 may be located external to a chip package, where the chip package includes reference stage 106, amplifier stages 108 and 110, and output buffer stage 112.

In the example of FIG. 2, the topology of error amplifiers LP OTA and HP OTA may be identical, but may differ in terms of size and are biased at very different current levels. For example, error amplifier LP OTA may have a small size and low bias currents. In this example, error amplifier HP OTA may have higher bias current levels and larger size when compared to error amplifier LP OTA. In some examples, targeted performance may be (+/−) 4% output voltage precision (including static and dynamic line and load regulation) in voltage regulation mode at low load current levels and (+/−) 2% output voltage precision at high load current levels. In some examples, (+/−) 2% output voltage precision may be achieved regardless of the load current level, but at the expense of additional quiescent current.

Each of error amplifiers LP OTA and HP OTA (e.g., a gm stage or OTA) generate a current proportional to the difference between the feedback signal ($V_{FB}$) and the on-chip band gap voltage reference ($V_{Bg}$). In some examples, these currents may be injected into a respective current mirror and multiplied by the ratio of the respective current mirror. For example, the current from error amplifier LP OTA may be formed by transistors M103 and M104 with a ratio N. In another example, the current from error amplifier HP OTA may be output buffer stage 112, formed by transistors M106 and M107 with a ratio M. In these examples, the currents from the respective current mirrors may be driving the base of external transistor T101 (e.g., a PNP BJT or PFET device).

Active peak comparator may include transistors M105 and SW1, and current sources $I_{REF_APK}$ and $I_{hyst}$ and Schmitt trigger T1. Because M105 is driven by the same current mirror master (e.g., M103) as M104, there is a strict relationship between the base current provided by error amplifier LP OTA and the active peak thresholds (e.g., "high power thresholds"). The rising (low to high power) and falling (high to low power) active peak thresholds (e.g., the transition points in the load and/or PNP base current) are programmed by choosing the value for the current source that provides current $I_{REF_APK}$ and the ratio between transistors M105 and M103. The hysteresis between the rising and falling thresholds is dimensioned by choosing the value for the current source that provides current $I_{hyst}$.

In some examples, when load 114 is in a low state, the current to maintain the voltage regulation level may also be low. In these examples, error amplifier LP OTA may be activated and error amplifiers HP OTA and PB/OC may be deactivated. In some examples, an active peak comparator may detect that the base current of transistor T101 has reached the rising threshold, and activates error amplifier HP OTA. In this manner, the transition of load 114 to a high state is done autonomously by the active peak comparator. In some examples, where transistor T101 is a PNP, the base current of transistor T101 may be the load current divided by the PNP beta. As the current to load 114 increases, the base current of transistor T101 may also increase with the majority of the base current being provided by error amplifier HP OTA. In some examples, error amplifier LP OTA may not deactivated when transistor T101 is above the rising threshold. In these examples, error amplifier LP OTA may provide a small fraction of the total base current even when error amplifier HP OTA is active. The same relationship between error amplifiers LP OTA and HP OTA may also be exhibited during a decrease in the load current. For example, when the active peak comparator detects that the base current decreases below the decreasing threshold, the active peak comparator may deactivate error amplifier HP OTA. The activation and deactivation of error amplifier HP OTA may be done very rapidly, so as to not affect the dynamic performance of LDO regulator system 100 during a very fast zero to maximum load current transition.

In some examples, to avoid active peak (APK) oscillations error amplifiers LP OTA and HP OTA may be set to regulate at slightly different voltages. An intended artificial offset (e.g., tens of mV) may be introduced for error amplifier LP OTA so that error amplifier LP OTA may have a higher voltage regulation point than error amplifier HP OTA. In these examples, the offset ensures that around the rising and falling thresholds, the base current output of error amplifier HP OTA is substantially close to zero. Without the offset, both error amplifiers LP OTA and HP OTA may regulate at the same voltage level, which may lead to oscillation between the rising and falling thresholds. In some examples, the offset needed to set the low power regulation point higher may be implemented by de-balancing error amplifier LP OTA with the small current $I_{offs_LP}$. In other examples, an alternative to current $I_{offs_LP}$ may be to connect the inverting input of error amplifier LP OTA to another tap of a slightly lower potential in the feedback resistor divider of LDO regulator system 100.

In some examples, an active clamp circuit may be included in the topology in the same manner as error amplifiers LP OTA and HP OTA are used in voltage regulation mode. For example, the non-inverting input of an error amplifier active clamp OTA may be connected to a tap in the resistor divider that may set the regulation point of the active clamp well above the regulation point of error amplifier LP OTA. In this way, the active clamp may not influence the rest of the circuit during normal operation but if the output voltage of LDO regulator system 100 reaches the active clamp regulation point the current injected by the error amplifier active clamp OTA into a current mirror and multiplied by the ratio of the current mirror may clamp the voltage. In some examples, the active clamp may pull-up the PNP base, sink current from the output of output buffer stage 112, and may also sink current from transistor M106 of output buffer stage 112 in order to keep the output voltage from rising further. In some examples, transistors MPB and M106 may be the same NODE but transistor M106 may be on in both voltage regulation mode and power balancing mode. In some examples, transistor M106 may be part of the output buffer stage and current from the output buffer may be diverted, which would be otherwise delivered to the transistor T201. In some examples, the active clamp may be used at substantially close to zero load current and high temperature (e.g., greater than 125° C.). In these examples, the active clamp may help reduce or prevent a PNP leakage current that may charge up the output node of LDO regulator system 100 despite transistor T201 (e.g., a PNP device) being driven into an OFF state. In some examples, the active clamp circuit may also quickly discharge the base of transistor T101. In some examples, the active clamp may also accelerate saturation recovery times, which may prevent large overshoots on the output of LDO regulator system 100 in case the battery voltage ($V_{BAT}$) recovers from very low levels (low drop operation) to nominal levels. For example, during a cranking pulse where the battery may recover from 5V to the nominal of 12V. The active clamp circuit may be active for both voltage regulation and power balancing modes.

Figure 3:
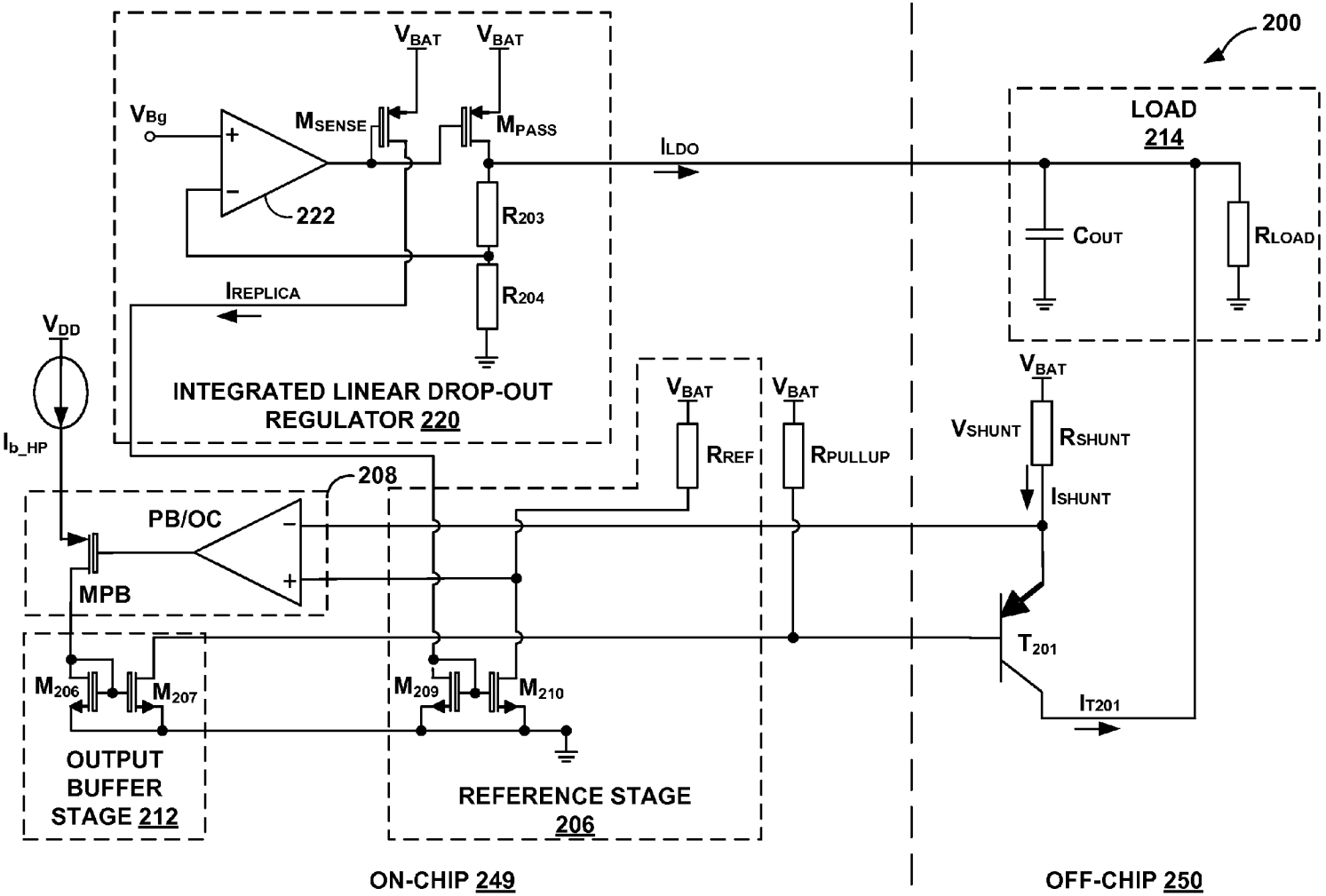
FIG. 3 is a circuit diagram illustrating an example of a power balancing mode of a LDO regulator system, in accordance with the techniques described in this disclosure.

FIG. 3 is a circuit diagram illustrating an example of a power balancing mode of a LDO regulator system 200, in accordance with the techniques described in this disclosure. FIG. 3 is described with reference to FIG. 1 and FIG. 2. For ease of understanding, FIG. 3 is illustrated with on-chip 249 and off-chip 250, where off-chip 250 may correspond to off-chip stage 50 and 150 as described in FIGS. 1 and 2. In the example of FIG. 3, resistors $R_{SHUNT}$ and $R_{REF}$, transistor T201, reference stage 206, amplifier stage 208, output buffer stage 212, and load 214 may correspond to resistor $R_{SHUNT}$ and $R_{REF}$, transistor T1, reference stage 6, amplifier stage 8, output buffer stage 12, and load 14 as described in FIG. 1.

In the example of FIG. 3, voltages $V_{BAT}$, $V_{Bg}$, and $V_{DD}$, currents $I_{REPLICA}$ and $I_{b_HP}$, resistors $R_{SHUNT}$, $R_{PULLUP}$, and $R_{REF}$, transistors M206, M207, M209, M210, and MPB, error amplifier PB/OC, reference stage 206, amplifier stage 208, output buffer stage 212, and load 214 may correspond to voltages $V_{BAT}$, $V_{Bg}$, and $V_{DD}$, currents $I_{REPLICA}$ and $I_{b_HP}$, resistors $R_{SHUNT}$, $R_{PULLUP}$, and $R_{REF}$, transistors M106, M107, M109, M110, and MPB, error amplifier PB/OC, reference stage 106, amplifier stage 108, output buffer stage 112, and load 114 as described in FIG. 2.

In the example of FIG. 3, LDO regulator system 200 further includes integrated drop-out linear regulator 220, $R_{LOAD}$ and capacitor $C_{OUT}$ of load 214, and current $I_{T201}$. Integrated LDO regulator 220 includes resistors R203 and R204, transistors $M_{SENSE}$ and $M_{PASS}$, error amplifier 222, and current $I_{LDO}$.

Resistor $R_{LOAD}$ is resistance value of load 214. In some examples, when resistor $R_{LOAD}$ increases, the current provided by LDO regulator system 200 must increase to maintain the voltage level at load 14. Conversely, when resistor $R_{LOAD}$ decreases, the current provided by LDO regulator system 200 may be decreased to maintain the voltage level at load 14. Capacitor $C_{OUT}$ is a capacitor in parallel with resistor $R_{LOAD}$. In some examples, capacitor $C_{OUT}$ may be a tank capacitor, which may assist in providing current to maintain the voltage level across resistor $R_{LOAD}$, while LDO regulator system 200 adjusts the current provided by transistors $M_{PASS}$ and T201.

Resistor $R_{PULLUP}$ may correspond to resistor $R_B$ as described in FIG. 1. For example, resistor $R_{PULLUP}$ may allow LDO regulator system 200 to provide a current control signal to drive a PNP bipolar junction transistor, or a voltage control signal to drive a p-channel field effect transistor.

Integrated LDO regulator 220 may comprise a fully integrated LDO regulator on the same chip as reference stage 206, amplifier stage 208, output buffer stage 212, and the current source that provides current $I_{b_HP}$. Resistors R203 and R204 of integrated LDO regulator 220 forms a voltage divider, and may correspond to resistors R1 and R2 as described in FIG. 1. In some examples, resistors R203 and R204 may provide a feedback voltage proportional to the output voltage across resistor $R_{LOAD}$ to the inverting input of error amplifier 222. Error amplifier 222 may be a differential amplifier or operational transconductance amplifier. Transistor $M_{PASS}$ is a transistor, including, but not limited to, a metal-oxide semiconductor field effect transistor (MOSFET), a PFET, PNP device or any other transistor that may output a load current to load 214. In some examples, transistor $M_{PASS}$ may drive the output of error amplifier 222, such that as the voltage level of load 214 changes, error amplifier 222 outputs a control signal to transistor $M_{PASS}$ to increase or decrease the load current provided to load 214. Transistor $M_{SENSE}$ is a transistor, including, but not limited to, a metal-oxide semiconductor field effect transistor (MOSFET), a PFET, PNP device or any other transistor that may output a replication current to transistor M209 of reference stage 206. In some examples, transistor $M_{SENSE}$ may drive the output of error amplifier PB/OC, such that as the current provided integrated LDO regulator 220 to load 214 is mirrored by the current provided by transistor T201 to load 214. Current $I_{LDO}$ is an amount of current provided by integrated LDO regulator 220 to load 214 to maintain the voltage level of load 214. In some examples, in power balancing mode, current $I_{LDO}$ may be a first portion of the total load current provided to load 214. Current $I_{T201}$ is an amount of current provided by transistor T201 to load 214 to maintain the voltage level of load 214. In some examples, in power balancing mode, current $I_{T201}$ may be a second portion of the total load current provided to load 214.

The difference between FIGS. 2 and 3 is that in power balancing mode both error amplifiers LP OTA and HP OTA are switched off and not illustrated in FIG. 3. In the example of FIG. 3, current $I_{b_HP}$ does not bias error amplifier HP OTA because error amplifier HP OTA is deactivated in power balancing mode, so current $I_{b_HP}$ is now regulated by transistor MPB. Current $I_{b_HP}$ is injected into output buffer stage 212 (i.e., a base driving current mirror) formed by transistors M206 and M207 that was used by error amplifier HP OTA in voltage regulation mode. One advantage of the topology as illustrated in FIG. 3 is that the largest portion of the circuit in terms of spent silicon area may be output buffer stage 212, the current source providing current $I_{b_HP}$, and error amplifier PB/OC, and these components may be utilized in both voltage regulation and power balancing modes.

In the example of FIG. 3, LDO regulator system 200 operating in the power balancing mode is based on the replication current ($I_{REPLICA}$) generated by integrated LDO regulator 220, which is proportional to the load current provided by integrated LDO regulator 220 to load 214. Transistor $M_{SENSE}$ which is supplying current $I_{REPLICA}$ is implemented as a finger of transistor $M_{PASS}$, which may be acting as a pass device. In some examples, a finger may be describing a unit transistor that makes up the large $M_{PASS}$ device. For example, a pass transistor may be formed by multiple finger devices connected in parallel. $I_{REPLICA}$ is received by a current mirror formed by transistors M209 and M210 of reference stage 206, which generates a voltage drop on $R_{REF}$ which is sensed by the non-inverting input of error amplifier PB/OC. Error amplifier PB/OC may drive transistor MPB to supply transistor T201 with a base current so that the voltage drop generated on the external shunt resistor ($R_{SHUNT}$) by the load current equals the voltage drop generated on resistor $R_{REF}$ by $I_{REPLICA}$. In some examples, the ratio of $M_{}_{PASS}$ over $M_{}_{SENSE}$ and the value of resistor $R_{REF}$ are fixed, and the ratio of $I_{T201}$ (e.g., $I_{PNP}$) over $I_{LDO}$ in the total load current (the power balancing ratio) is a function of the value of resistor $R_{SHUNT}$.

In some examples, an active clamp circuit may be included in the topology in the same manner as error amplifiers LP OTA and HP OTA are used in voltage regulation mode. For example, the non-inverting input of an error amplifier active clamp OTA may be connected to a tap in the resistor divider that may set the regulation point of the active clamp well above the regulation point of error amplifier LP OTA. In this way, the active clamp may not influence the rest of the circuit during normal operation but if the output voltage of LDO regulator system 200 reaches the active clamp regulation point the current injected by the error amplifier active clamp OTA into a current mirror and multiplied may clamp the voltage. In some examples, the active clamp may pull-up the PNP base, sink current from the output of output buffer stage 212, and may also sink current from transistor MPB of output buffer stage 212 in order to keep the output voltage from rising further. In some examples, the active clamp may be used at substantially close to zero load current and high temperature (e.g., greater than 125° C.). In these examples, the active clamp may help reduce or prevent a PNP leakage current that may charge up the output node of LDO regulator system 200 despite transistor T201 (e.g., a PNP device) being driven into an OFF state. In some examples, the active clamp circuit may also quickly discharge the base of transistor T201. In some examples, the active clamp may also accelerate saturation recovery times, which may prevent large overshoots on the output of LDO regulator system 200 in case the battery voltage ($V_{BAT}$) recovers from very low levels (low drop operation) to nominal levels. For example, during a cranking pulse where the battery may recover from 5V to the nominal of 12V. The active clamp circuit may be active for both voltage regulation and power balancing modes.

Figure 4:
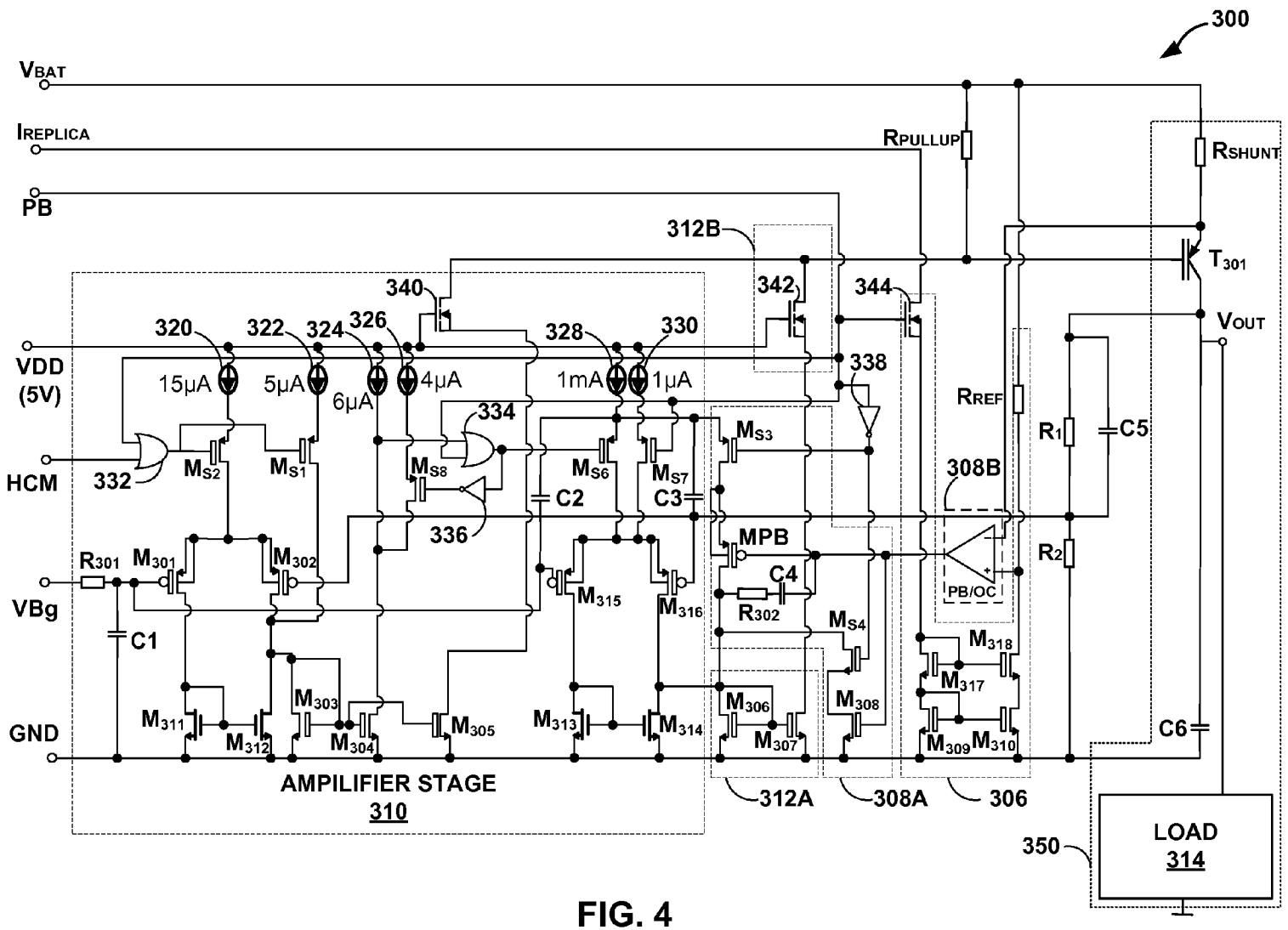
FIG. 4 is a circuit diagram illustrating a more detailed example of a LDO regulator system, in accordance with this disclosure.

FIG. 4 is a circuit diagram illustrating a more detailed example of a LDO regulator system 300, in accordance with this disclosure. FIG. 4 is described with reference to FIG. 1 and FIG. 2. In the example of FIG. 4, resistors $R_{SHUNT}$ and $R_{REF}$, transistor T301, reference stage 306, amplifier stage 308A and 308B (collectively "amplifier stage 308"), amplifier stage 310, output buffer stage 312A and 312B (collectively "output buffer stage 312"), and load 314 may correspond to resistor $R_{SHUNT}$ and $R_{REF}$, transistor T1, reference stage 6, amplifier stage 8, amplifier stage 10, output buffer stage 12, and load 14 as described in FIG. 1.

In the example of FIG. 4, voltages $V_{BAT}$, $V_{Bg}$, and $V_{DD}$, current $I_{REPLICA}$, transistors M303-M310, and MPB, error amplifier PB/OC, reference stage 306, amplifier stage 308A and 308B, amplifier stage 310, output buffer stage 312A and 312B, and load 314 may correspond to voltages $V_{BAT}$, $V_{Bg}$, and $V_{DD}$, currents $I_{REPLICA}$, transistors M103-M110, and MPB, error amplifier PB/OC, reference stage 106, amplifier stage 108, amplifier stage 110, output buffer stage 112, and load 114 as described in FIG. 2.

In the example of FIG. 4, LDO regulator system 300 further includes inputs PB and HCM, capacitors C1-C6, resistors R301-R302 and $R_{PULLUP}$, transistors MS1-MS8, M301-M302, M311-314, M315-M316, and M317-M318, current sources 320-330, OR gates 332-334, inverters 336-338, voltage separators (e.g., high-voltage compliant transistors) 340-344.

Input PB is a control signal that is indicative of a selection of the power balancing mode of LDO regulator system 300. For example, input PB may be a voltage signal that activates the power balancing mode of LDO regulator system 300. Input HCM is a control signal that is indicative of a high current mode. In some examples, input HCM may be a user enforced active peak signal. For example, input HCM may be a voltage signal that activates error amplifier HP OTA in addition to error amplifier LP OTA in order to enhance the regulator precision even at low load currents with the expense of additional quiescent current. In other words, if input HCM is not asserted LDO regulator system 300 will have better precision after the load current increases and the active peak comparator turns on the high power error amplifier. Conversely, if the HCM signal is asserted, LDO regulator system 300 will always have the best precision regardless of the level of the load current, but at the expense of additional quiescent current).

Capacitor C5 may be used to speed-up the response of LDO regulator system 300 when working in voltage regulation mode by introducing a zero in the transfer function of LDO regulator system 300. Capacitor C1 may be of the exact same type and value as capacitor C5. In some examples, capacitor C1 may be used for symmetry purposes, so that both inputs of the high power error amplifier have similar capacitive loads. Capacitors C2 and C3 may form a closed voltage loop together with the gate to source capacitances of transistor $M_{315}$ and $M_{316}$. For example, when transistor (switch) Ms6 may be turned on to supply current to the high power error amplifier, and charge redistribution inside this closed voltage loop may significantly decrease the risk of triggering active peak oscillations. Capacitor C4 may be used as part of a Miller compensation network that ensures system stability during operation in power balancing mode at low load current levels. Capacitor C6 corresponds to capacitor $C_{OUT}$ as described in FIG. 3 and is located external on off-chip stage 350. For example, capacitor C6 may act as a tank capacitor, which provides current to load 314 while LDO regulator system 300 is adjusting the current through transistor T301. In some examples, capacitor C6 may be 4.7 microfarads (μF).

Resistors R301-R302 are passive electrical components with a resistive value. R301 may have the value of the parallel combination of resistors R1 and R2, and may be placed with capacitor C1 for symmetry purposes (e.g., to avoid active peak oscillations). R302 may form with capacitor C4 a Miller compensation network that ensures system stability during operation of LDO regulator system 300 in power balancing mode at low load current levels.

Resistor $R_{PULLUP}$ is a passive electrical component with a resistive value and may be a resistor used for pulling up the base (gate) of the PNP (PMOS) pass transistor, which may be necessary for closing the pass transistor when LDO regulator system 300 may not be providing any load current. In some examples, resistor $R_{PULLUP}$ may correspond to resistor RB as described in FIG. 1. In some examples, if a PMOS pass device is used instead of a PNP pass device, resistor $R_{PULLUP}$ may also translate the output from output buffer stage 312 from a current suitable for PNP control to a voltage suitable for PMOS control.

Transistors M301 and M302 (e.g., medium voltage PMOS (P-type channel MOS) transistors) may be used in a differential input stage configuration together with transistors M311 and M312 (e.g., the low voltage NMOS transistors) acting as the active load of error amplifier LP OTA as described in FIG. 2. The current generated by error amplifier LP OTA may be injected into the current mirror formed by transistors M303 and M304, which may be realized using medium voltage NMOS transistors and may have the role of an output buffer for error amplifier LP OTA as described in FIG. 2.

Transistors M315 and M316 (e.g., medium voltage PMOS (P-type channel MOS) transistors) may be used in a differential input stage configuration together with transistors M313 and M314 (e.g., the low voltage NMOS transistors) may act as the active load of error amplifier HP OTA as described in FIG. 2. The current generated by error amplifier HP OTA may be injected into a current mirror formed by transistors M306 and M307, which may be realized using medium voltage NMOS transistors and may have the role of an output buffer for error amplifier HP OTA (e.g., output buffer 312A as described in FIG. 4).

Transistors M309 and M310 (e.g., medium voltage NMOS transistors) together with transistors M317 and M318 may form a cascode current mirror. In some examples, transistors M309 and M310 with transistors M317 and M318 may correspond to a current mirror formed by transistors M109 and M110 as described in FIG. 2. Transistors M317 and M318 may be cascode transistors, which may increase the output impedance and implicitly the current copying precision of the basic current mirror M309 and M310.

Transistor M308 (e.g., a medium voltage NMOS transistor) may correspond to transistor M108 as described in FIG. 2, Transistor MPB (e.g., a medium voltage PMOS transistor) may correspond to transistor MPB as described in FIGS. 2 and 3.

Current source 320 provides a current, which may be fifteen micro-amps (μA) and may correspond to current $I_{b_LP}$ as described in FIG. 2. Current source 322 provides a current, which may be five micro-amps (μA) and may correspond to current $I_{offs_LP}$ as described in FIG. 2. Current source 324 provides a current, which may be six micro-amps (μA) and may correspond to current $I_{REF_APK}$ as described in FIG. 2. Current source 326 provides a current, which may be four micro-amps (μA) and may correspond to current $I_{hyst}$ as described in FIG. 2. Current source 328 provides a current, which may be one milliamp (mA) and may correspond to current $I_{b_HP}$ as described in FIG. 2. Current source 330 provides a current, which may be one micro-amp (μA) and may be used to pre-charge the gate to source capacitances of transistors M315 and M316 before the high power error amplifier is turned on.

Switches MS1-MS3, and MS5-MS8 may be serial PMOS switches implemented with medium voltage transistors. Switch MS4 may be implemented using a medium voltage NMOS transistor. Switches MS1-MS2 may disconnect the current sources used by the low power error amplifier when the low power error amplifier is not operating. Switch MS3 may correspond to S2 as described FIG. 2 and connects the $I_{b_HP}$ current source to the MPB transistor in power balancing mode. Switch MS4 may correspond to switch S3 as described in FIG. 2 and may connect transistor M308 to output buffer 312 when LDO regulator system 300 is operating in voltage regulation mode. Switch MS8 may be part of the active peak comparator and may correspond to switch SW1 in FIG. 2. Switch MS6 may connect the $I_{b_HP}$ current source to the high power error amplifier in voltage regulation mode. Switch MS7 may connect the pre-charge 1 μA current source to the high power error amplifier in voltage regulation mode.

OR gates 332-334 are each a digital logic gate that implements logical disjunction. For example, OR gates 332-334 may output a LOW if both inputs are LOW, and may a HIGH if either inputs are HIGH. Inverters 336-338 are each a digital logic gate that implements logical negation. For example, inverters 336-338 may output a LOW if the input is HIGH, and may output a HIGH if the input is LOW.

Voltage separators 340-342 may provide the base current to transistor T301. For example, in low power mode of voltage regulation mode, voltage separator 340 may provide the base current to transistor T301. In another example, in high power mode of voltage regulation mode, voltage separators 340 and 342 may both provide the base current to transistor T301. Voltage separator 344 may provide the replication current to reference stage 306. For example, in power balancing mode, voltage separator 344 may provide the replication current to reference stage 306 to drive amplifier stages 308A and 308B (e.g., transistor MPB from transistor 308B) to provide a control signal to drive transistor T301 to provide a current that mirrors the replication current.

In the example of FIG. 4, LDO regulator system 300 is illustrated in a standard automotive bipolar CMOS DMOS (BCD) technology that provides several CMOS voltage classes. For example, LDO regulator system 300 may include low voltage (1.5V) analog and logic transistors, medium voltage analog transistors, high voltage (60V) DMOS power transistors, and bipolar diodes and transistors.

In voltage regulation mode, the output voltage of LDO regulator system 300 may be configurable between 5V, 3.3V, 1.8V, 1.2V. In power balancing mode, the output voltage of the separate integrated LDO (e.g., integrated LDO regulator 220 as described in FIG. 3) may only be configurable between 5V and 3.3V, so the power balancing mode may only operate at 5V and 3.3V.

In some examples, load 314 may also be a high performance microcontroller generating very rapid and high amplitude load steps to an externally compensated regulator topology. In these examples, a high bandwidth error amplifier is preferable in order to obtain a very fast dynamic load regulation response and avoid a system reset.

In the example of FIG. 4, capacitor C6 may be an external ceramic capacitor and may establish the dominant pole of the regulation loop. By using the external capacitor to establish the dominant pole of the regulation loop, the poles inside each error amplifier must be located as high as possible in frequency to ensure sufficient phase margin and stability.

In some examples, it may be advantageous to place capacitor C6 as close as possible to the collector or drain of transistor T301 for use in voltage regulation mode and as close as possible to the output pin of the fully integrated separate LDO regulator for use in power balancing mode (i.e., extending the load capability of the fully integrated separate LDO regulator).

LDO regulator system 300 may provide the base current or gate voltage needed to control transistor T301. LDO regulator system 300 may also have separate inputs for sensing the level of the regulated voltage and the level of the voltage drop on an external shunt resistor in series with the load current in order to provide over current limitation and detection or to establish the power balancing ratio during operation in power balancing mode.

In order to maintain a low quiescent current, LDO regulator system 300 may be comprised of two similar topology error-amplifiers one working in light load conditions with a small tail (e.g. a bias current) current (15 uA) and the other working in heavy load conditions with a tail current of 1 mA. In the voltage regulation mode, when load 314 of LDO regulator system 300 is low the base current or gate voltage of transistor T301 that must be provided in order to maintain the regulation level is also low. In this low load condition in voltage regulation mode, only the low-power (LP) error amplifier (e.g., error amplifier LP OTA as described in FIG. 2.) may be operating, which may result in a quiescent current in the tens of micro-amps (μA). In the voltage regulation mode, the transition of LDO regulator system 300 to operating in a high load condition may be done autonomously when an active peak comparator detects that a base current or a gate voltage of transistor T301 has surpassed a threshold. For example, when transistor T301 is a PNP bipolar junction transistor, and the base current has surpassed 50 uA (10 mA load current assuming a PNP beta of 200), LDO regulator system 300 may activate the high power error amplifier (e.g., error amplifier HP OTA as described in FIG. 2). As the load condition of load 114 increases, the base current or gate voltage of transistor T301 may also increase with the majority of the base current or gate voltage being provided by the high power error amplifier. The low error amplifier may not deactivate in high power load condition because the low power error amplifier may still provide a small fraction of the total base current or gate voltage even when the high power error amplifier is activated.

For example, LDO regulator system 300 may be in low power mode having a constant light load (e.g., a PNP base current under 50 uA) and may be subjected to a sudden and high amplitude jump in the load condition of load 314. In some examples, load 214 may be a microcontroller waking up or performing a boot sequence. After the jump in load condition has passed, and the load condition of load 314 returns to low levels the active peak comparator will automatically shut down the high power error amplifier. In some examples, the lower gain of the low power error amplifier reduces the precision of LDO regulator system 300. For example, the precision of LDO regulator system 300 may be poorer (+/−4%) when LDO regulator system 300 is operating in low power mode of voltage regulation mode.

In some examples, the high power error amplifier may be activated at all load conditions to provide an enhanced precision mode regardless of the load current. In these examples, enhanced precision mode may offer the best static load regulation precision and dynamic load regulation response. In these examples, enhanced precision mode may be activated by driving the HCM input to a HIGH state. In some examples, when the enhanced precision is activated, the low power error amplifier and the active peak comparator may be deactivated in LDO regulator system 300.

In some examples, the low and high power error amplifiers may have slightly different regulation voltages in order to avoid active peak oscillations around a transition threshold. In some examples, the transition threshold may be fifty micro-amps (μA). As descried above, the low power error amplifier (e.g. error amplifier LP OTA as described in FIG. 2) may have a regulation level above the high power error amplifier (e.g., error amplifier HP OTA as described in FIG. 2). In some examples, the higher regulation level of the low power error amplifier may be introduced by an artificial offset inside the low power error amplifier. For example, by injecting five micro-amps (μA) into the right branch of the amplifier by current source 322 and through transistor MS1.

In the example of FIG. 4, the low power error amplifier and the high power error amplifier of amplifier stage 310 are essentially differently scaled versions of the same amplifier structure. In this manner, each error amplifier may have a gm stage (a simple differential stage) driving a current source (e.g., a current mirror) that is providing the base current or gate voltage to transistor T301. For example, the gm stage of the low power error amplifier may be formed by transistors M301 and M302 differential stage with transistors M311 and M312 active load that generate a current difference proportional to the difference between the reference voltage (e.g., $V_{Bg}$ as described in FIG. 2) and the feedback voltage (e.g., $V_{FB}$ as described in FIG. 2). In the example of FIG. 4, the current difference may be injected into the drain of transistor M303 and is multiplied by transistor M304. Transistor M305 may be connected in series with voltage separator 340, which may deliver the actual base current or gate voltage to transistor T301 when LDO regulator system 300 is operating in a low power mode of voltage regulation mode. In some examples, voltage separator 340 may be a N-type lateral DMOS (NLDMOS) voltage separator transistor.

In the example of FIG. 4, from an small signal analysis point of view, each low power and high power error amplifier may have the first pole at the drain node of transistors M302/M316, M312/M314, at 1/[(RdsM312||RdsM302||1/gmM303)*(CgsM303+CdbM303+CdbM312+CdbM302+CgdM312+CgdM302)] and the second much higher frequency mirror pole at the drain of transistor M311. The first pole may be a function of the load current mainly because the gm of M303 heavily depends on the level of injected current which basically depends on the level of base current needed to maintain the regulated voltage level. From the low power error amplifier perspective the minimum phase margin occurs at low levels of current injection when the gm of diode connected M303 is minimal and the pole is closest to the externally set dominant pole.

In some examples, the active load of both the low power and high power error amplifiers may be implemented with analog low voltage transistors, which may help to suppress current copying errors without having to require a cascode configuration. In these examples, transistors M311/M312 may be low voltage (LV) transistors the maximum $V_{GS}$ (e.g., gate to source voltage) of the medium voltage transistor M303 and respectively transistor M306 for the high power amplifier cannot exceed the maximum drain to source voltage allowed by the low voltage transistors (e.g., $VDS_{LV,max}$). Transistor M306 may also be configured to not exceed a gate to source voltage larger than $VDS_{LV,max}$ when conducting the full tail current of 1 mA during maximum load and low PNP beta conditions. In some examples, in order to maximize the gm, transistors M301, M302, M315, and M316 are operating in weak inversion, where weak inversion operation has highest gm/Id. For instance, weak inversion may be achieved by providing a high W/L (width over length) ratio while biased at a low current density. In the example of FIG. 4, transistors M303, M305, M306, and M307 may not implemented with low voltage transistors because cascoding may be required for transistor M307 (e.g., a voltage cascode may be used to conduct>50 mA at an overdrive of less than 700 mV).

In the example of FIG. 4, transistor M304 and the 6 uA and 4 uA current sources connected to the drain of transistor M304 are forming the active peak comparator as discussed above. In some examples, the ratio of M303:M304:M305 are 1:16:80 (M305/M304=80/16=5), which means that there may be a PNP base current of fifty micro-amps (μA) through transistor M305. In these examples, the current through transistor M304 may be ten micro-amps and the active peak comparator output may go LOW activating switch MS6 of the high power tail current mirror providing the bias current for turning on the high power error amplifier (e.g., error amplifier HP OTA). The current through switch MS8 of current source 326 provides the hysteresis of the active peak comparator.

Capacitors C2 and C3 may be placed between the source of the PMOS switch MS6 (separating the 1 mA tail current source) and voltage $V_{Bg}$ (band gap reference) and voltage $V_{FB}$ (feedback divider signal) in order to form a closed voltage loop with the large gate to source capacitances of transistors M315 and M316. Inside the closed voltage loop charge sharing and redistribution may occur when switch MS6 is activated minimizing the effects of charge injection on the reference line and reducing the risk of an active peak oscillation. Active peak oscillation may be triggered when activating switch MS6 to supply the bias current to the high power error amplifier. In some examples, a fast current spike may couple through the large gate to source capacitance of M316 to voltage $V_{FB}$ line increasing the potential of voltage $V_{FB}$ line and causing the drain current of transistor M302 to decrease thereby also decreasing the drain currents of M303 and M304. If the drain current of M305 goes down then the active peak comparator output will be pulled to a logical HIGH signal disabling the MS6 switch and the high power error amplifier. However, if external conditions (e.g., load 314) dictate that the PNP base current exceed 50 uA, the active peak comparator output may go to logical LOW and the cycle restarts. Reducing charge injection through the gate to source capacitance of MM315 may minimize the perturbation on voltage $V_{Bg}$ line (reference kickback).

The resistance of resistor R301 on the $V_{Bg}$ (reference) line in series with the gates of M301 and M315 and limits the injected current into the input of voltage $V_{Bg}$ during a transient spike. In some examples, the resistance value may be chosen in order to provide impedance matching between the two inputs of the low power and high power error amplifiers. For example, the resistance value of resistor R301 may be the small signal (AC) resistance seen at the gates of M302 and M316 due to the resistor divider formed by resistors R1 and R2. Capacitor C1 between the gates of M301 and M315 and ground may be placed to match capacitor C5, which may be a speed-up capacitor that bypasses resistor R1 of the feedback resistor divider. In some examples, capacitor C5 may greatly speed up the response of LDO regulator system 300 during load jumps. For example, capacitor C5 may introduce a zero in the transfer function of LDO regulator system 300 operating in voltage regulation mode, which may increase the bandwidth of LDO regulator system 300, and may act like a bypass for the high frequency components present in a sharp edge transition on the feedback voltage signal (e.g., $V_{FB}$). In the example of FIG. 4, current source 330 may provide a one micro-amp (μA) current in series with switch MS7, and may pre-charge the gate to source capacitances of the M315 and M316 differential pair in order for the charge compensation mechanism to function properly.

In some examples, an active clamp circuit may be included in LDO regulator system 300 in order to clamp (limit) an increase in potential at the output of LDO regulator system 300 above four percent of the programmed voltage. In some examples, the increase in potential may occur from PNP emitter-collector leakage at hot (e.g., above 125° C.) or low load conditions of load 314. In a low load condition at load 314, the LDO regulator system 300 output (e.g., $V_{OUT}$ as described in FIG. 4) may slowly (e.g., in tens of milliseconds) be pulled to voltage $V_{BAT}$ by this leakage. When the output voltage $V_{OUT}$ is above the desired (e.g., programmed) value the closed voltage loop may be out of regulation and LDO regulator system 300 may not be able to counteract the slow potential rise without an active clamp circuit.

In some examples, the amplifier that forms the active clamp may have the same basic structure as the low power and high power error amplifiers and may be a scaled down version (in terms of differential stage area) of the same topology. In these examples, the active clamp amplifier input may be connected to another tap in the feedback resistor divider making it active only if the output voltage exceeds the maximum spec limit for normal operation (e.g., 5.2V when the 5V output is programmed). For example, a pull down transistor may reduce the output of LDO regulator system 300 directly while a current mirror formed by two transistors may act like a strong pull-up for the transistor base. In this example, a pull-up resistor may be used and at above 125° C. the voltage drop generated across the pull-up resistor by the leakage of the high power error amplifier may sufficient to generate more than a hundred millivolt (mV) base emitter voltage. In some examples, the hundred millivolt base emitter voltage may generate substantial (e.g., micro-amps range) collector-emitter leakage, and increase the pull down current consumed by the pull down transistor in order to maintain the maximum 5.2V at the output of LDO regulator system 300. In some examples, where only a pull down resistor may be used the quiescent current consumption of LDO regulator system 300 in clamp mode may exceed 600 uA. In these examples, where a current mirror may be included in addition to the pull down transistor the total regulator quiescent current may be typically below 90 uA when the active clamp is activated.

One advantage of LDO regulator system 300 may be the ability to reuse part of the circuitry while operating in either voltage regulation mode or power balancing mode. For example, when LDO regulator system 300 is operating in power balancing mode the differential stage of the high power error amplifier may disabled and the 1 mA tail current may routed through switch MS3 and a power balancing regulation transistor MPB. Transistor MPB may dictate the level of injected current into the diode connected transistor M306, and accordingly the base current/collector current in relation to the voltage drop on the power balancing resistor $R_{REF}$. The voltage drop on $R_{REF}$ may be proportional to a replication current (e.g., $I_{REPLICA}$) of the load current injected and multiplied by the cascode current mirror present in the circuit. The voltage drop on resistor $R_{REF}$ may be received at the non-inverting input of the PB/OC amplifier that controls the gate of transistor MPB. The ratio between the collector current of transistor T301 and the load current of $V_{OUT}$ (the power balancing ratio) may be maintained by detecting the voltage drop on the external shunt resistor (e.g., $R_{SHUNT}$). In this example, resistor $R_{SHUNT}$ may be connected to the inverting input of the PB/OC amplifier and may be used to program the desired power balancing ratio based on the chosen resistor value. In some examples, resistor $R_{SHUNT}$ may be chosen according to the desired power balancing ratio and the actual power rating of the external PNP pass transistor. Another advantage of LDO regulator system 300 is the ability to use the current mirror in output buffer stage 312 and the same 1 mA current source in the voltage regulation mode and the power balancing mode leading to a substantial decrease in silicon area used for LDO regulator system 300.

Figure 5:
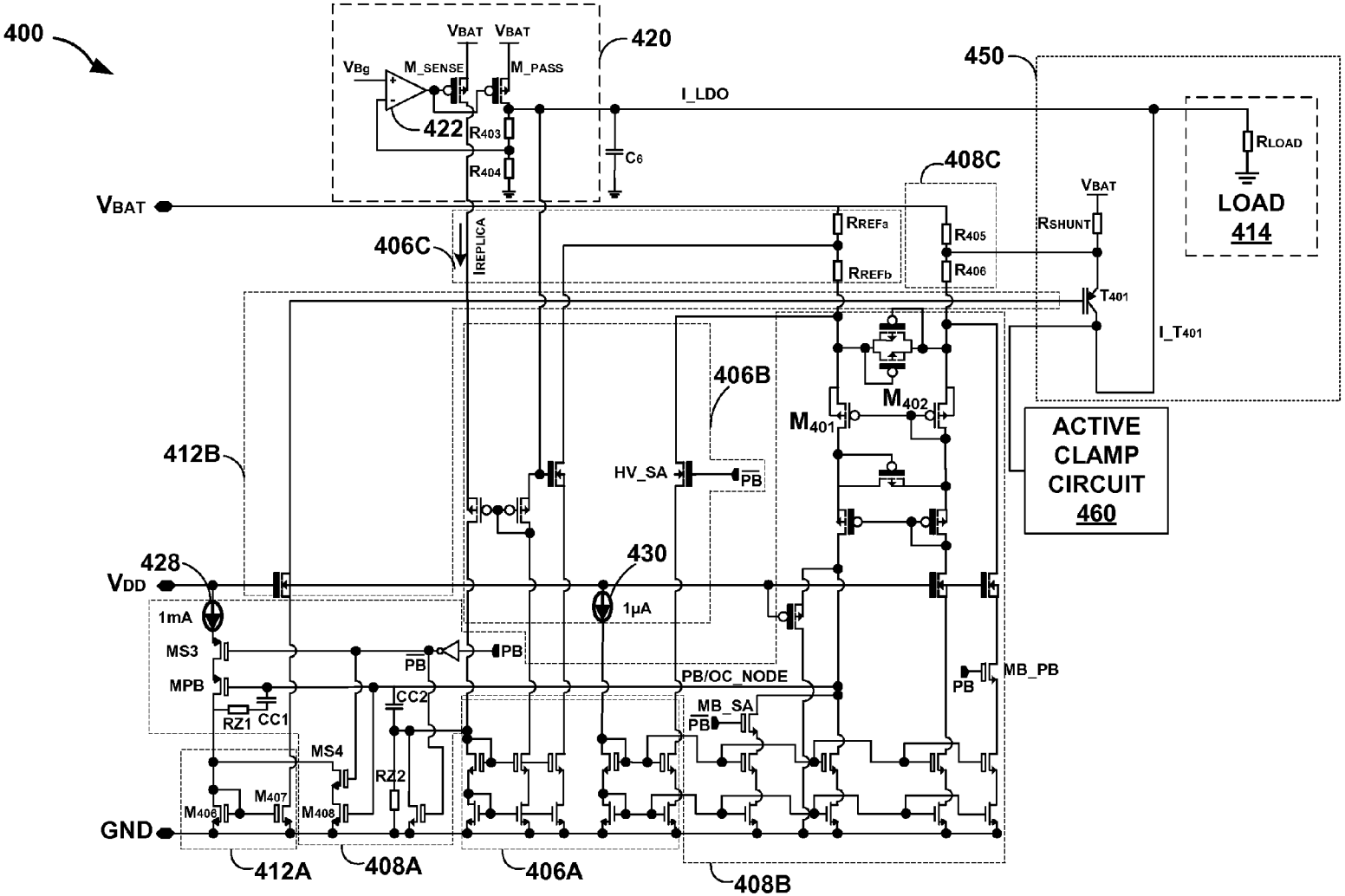
FIG. 5 is a circuit diagram illustrating a more detailed example of operating a LDO regulator system in power balancing mode, in accordance with this disclosure.

FIG. 5 is a circuit diagram illustrating a more detailed example of operating a LDO regulator system in power balancing mode, in accordance with this disclosure. FIG. 5 is described with reference to FIG. 1 and FIG. 2 and FIG. 3. For ease of understanding, only control transistors are described in FIG. 5; however, the transistors described in FIGS. 1-4 may also be used in FIG. 5 with respect to the different stages.

In the example of FIG. 5, resistors $R_{SHUNT}$ and $R_{REFa}$-$R_{REFb}$, transistor T401, reference stage 406A-406C, amplifier stage 408A-408C, output buffer stage 412A and 412B, load 414, and off-chip stage 450 may correspond to resistor $R_{SHUNT}$ and $R_{REF}$, transistor T1, reference stage 6, amplifier stage 8, output buffer stage 12, load 14, and off-chip stage 50 as described in FIG. 1. In the example of FIG. 5, voltages $V_{BAT}$, $V_{Bg}$, and $V_{DD}$, current $I_{REPLICA}$, transistors M406-M407, and MPB, reference stage 406A-406C (collectively "reference stage 406"), amplifier stage 408A-408C (collectively "amplifier stage 408"), output buffer stage 412A and 412B (collectively "output buffer stage 412"), and load 414 may correspond to voltages $V_{BAT}$, $V_{Bg}$, and $V_{DD}$, current $I_{REPLICA}$, transistors M106-M107, and MPB, reference stage 106, amplifier stage 108, output buffer stage 112, and load 114 as described in FIG. 2. In the example of FIG. 5, separate fully integrated LDO regulator 420, differential amplifier 422, current source 428, resistors $R_{403}$ and $R_{404}$, transistors $M_{_SENSE}$ and $M_{_PASS}$, and currents $I_{_LDO}$ and $I_{REPLICA}$ may correspond to integrated LDO regulator 220, differential amplifier 222, current $I_{b_HP}$, resistors $R_{203}$ and $R_{204}$, transistors $M_{SENSE}$ and $M_{PASS}$, and current $I_{LDO}$ and $I_{REPLICA}$ as described in FIG. 3. In the example of FIG. 5, input PB, capacitor C6, switches MS3 and MS4, resistor RZ1, capacitor CC1, and active clamp circuit 460 may correspond to input PB, capacitor C6, switches MS3 and MS4, resistor R302, capacitor C4, and the active clamp circuit as described in FIG. 4.

In the example of FIG. 5, LDO regulator system 400 further includes transistors MB_SA, MB_PB, HV_SA, resistors RZ2, $R_{405}$, and $R_{406}$, current source 430, and capacitor CC2. Transistors MS3, MB_SA, MB_PB, and M408 may be medium voltage transistors. Transistor HV_SA may be a N-type DMOS transistor used as both a voltage separator and a switch at the same time. In some examples, transistor HV_SA may be turned on in voltage regulation mode and may be turned off in power balancing mode. Current source 430 may be connected to a current mirror in reference stage 406, and current source 430 may provide current to the current mirror (e.g., 1 micro-amp).

When operating in voltage regulation mode, error amplifier PB/OC (e.g., error amplifier PB/OC as described in FIGS. 2-4), external shunt resistor (e.g., $R_{SHUNT}$ as described in FIG. 1) and transistor M408 form the over-current limitation circuit of LDO regulator system 400. In the example of FIG. 5, when the voltage drop on the external $R_{SHUNT}$ increases, the potential of the inverting input of error amplifier PB/OC amp decreases leading to an increase of the M408 gate potential (PB/OC gain node) and more current may be sinked from the driving current mirror of output buffer stage 412. In some examples, transistor M408 may take away base current from transistor T401 when the load current (e.g., PNP collector current) causes the voltage drop on resistor $R_{SHUNT}$ to exceed a specific threshold. In this manner, resistor $R_{SHUNT}$ may be chosen according to the maximum power handling capabilities of transistor T401 (e.g., a PNP or PFET pass device). For example, a BCP 52 PNP pass device may tolerate a maximum power dissipation of 2 W. In this example, the maximum power dissipation of two watts (W) may translate into a two hundred milliamp (mA) maximum load current when the battery voltage (e.g., $V_{BAT}$) is 13.5V. In one example, by choosing a one ohm (Ω) resistance value for resistor $R_{SHUNT}$ and an over-current limitation of two hundred and forty-five millivolts (mV) (nominal), the load current is two hundred and forty-five milliamps (mA) at which the over-current limitation circuit of LDO regulator system 400 will activate. In another example, by choosing a five hundred milliohms (mΩ) resistor the two hundred and forty-five millivolt threshold across $R_{SHUNT}$ may be obtained at load current of five hundred milliamps (mA).

The inputs of error amplifier PB/OC are the source terminals of transistors M401 and M402 which forms the gm stage of error amplifier PB/OC. The output of the gm stage of error amplifier PB/OC is the PB/OC high impedance node that depending on the operating mode (voltage regulation mode or power balancing mode) drives transistors MPB or M408. Transistors MS3 and MS4 may be used to disconnect the power balancing circuitry in voltage operation mode and the over current functionality in power balancing mode.

Between the drain and gate of transistor MPB, capacitor CC1 and resistor RZ1 forms a RC Miller compensation, which may be used to ensure the stability of the regulating loop in power balancing mode at very low load currents. For example, at a low load condition of load 414, the level of injected current into M406 is low and the impedance of M406 is high (e.g., 1/gmM406). In this example, the amplification of the common source stage composed of MPB and M406 may be sufficiently high to ensure that the dominant pole set by the Miller compensation is low enough in frequency to become the dominant pole and ensure stability. In some examples, resistor RZ2 and capacitor CC2 may form an additional internal RC Miller compensation of error amplifier PB/OC for higher levels of current when the amplification of the RC Miller formed by capacitor CC1 and resistor RZ1 drops. In these examples, the RC Miller compensation may help to reduce in size the silicon area that would otherwise be used to have a stable loop regardless of the base current (e.g., PNP current).

In voltage regulation mode (e.g., when the PB signal is logic LOW), transistor MB_SA may be activated, which may connect an offset introducing current source to keep the PB/OC node at a well-defined potential at low PNP collector currents. For example, at very low PNP currents the voltage drop on $R_{SHUNT}$ may be very low, and error amplifier PB/OC inputs are practically at the same potential and the PB/OC node can be in high impedance. During voltage regulation mode switch HV_SA may be closed and voltage $V_{REF}$ for error amplifier PB/OC may be generated on resistor $R_{REF}$, with $R_{REF}=R_{REFa}+R_{REFb}$.

In power balancing mode (e.g., when the PB signal is logic HIGH), transistor MB_PB may be activated, and introduces an artificial offset that ensures that output buffer stage 412 may only provide base current to transistor T401 if a certain load level is exceeded by separate fully integrated LDO regulator 420. In some examples, the load level of separate fully integrated LDO regulator 420 may be is fifteen milliamps (mA). During power balancing mode, current $I_{REPLICA}$ may generate a voltage drop only on resistor $R_{REFa}$, with $R_{REF}=R_{REFa}$.

FIG. 6 is a table illustrating specifications of a LDO regulator system, in accordance with this disclosure. In the example of FIG. 6, input voltage range 502 corresponding to $V_{SUPPLY}$ and $V_{BAT}$ as described in FIGS. 1-5, may be between 4.5 volts (V) and 28V for $V_{OUT}$ equal to 3.3V, 1.8V, and 1.2V, or may be between 5.5V and 28V for $V_{OUT}$ equal to 5V. In the example of FIG. 6, typical quiescent current in low power mode 504 corresponds to low power mode in FIG. 4, may be 40 micro-amps (μA) at zero load current. In the example of FIG. 6, low power mode output voltage precision 506 including static and dynamic load regulation may be plus or minus 4% at low load currents and when active peak comparator is off. In the example of FIG. 6, high power mode output voltage precision 508 including static and dynamic load regulation may be plus or minus 2% for $V_{OUT}$ equal to 5 volts (V) and 3.3V, or may be plus or minus 3% for $V_{OUT}$ equal to 1.8V and 1.2V. In the example of FIG. 6, active peak rising threshold PNP base current 510 may be 50 micro-amps (μA), which may translate to a 8.5 milliamp (mA) load current for a PNP beta of 150. In the example of FIG. 6, active peak falling threshold PNP base current 512 may be 30 micro-amps (μA), which may translate to a 4.5 milliamp (mA) load current for a PNP beta of 150. In the example of FIG. 6, over-current shunt voltage threshold 514 may be 245 millivolts (mV), which may translate to 490 mA load current for a $R_{SHUNT}$ resistance of 0.5 Ohms (Ω) and 245 mA load current for a $R_{SHUNT}$ resistance of 1Ω. In the example of FIG. 6, power balancing ratio I_PNP:I_LDO 516, where I_PNP corresponds to current $I_{T201}$ and I_LDO corresponds to current $I_{LDO}$ as described in FIG. 2 may be 1:1 ratio with a $R_{SHUNT}$ resistance value of 1Ω and a 2:1 ratio with a $R_{SHUNT}$ resistance value of 0.5Ω. In the example of FIG. 6, maximum base current 518 may be 60 milliamps (mA). In the example of FIG. 6, output capacitor 520 corresponding to C6 as described in FIG. 4, in voltage regulation mode may be 4.7 microfarads (μF) placed at the collector of the PNP device, and in power balancing mode may be 10 microfarads (μF) placed at the output pin of the integrated LDO regulator corresponding to integrated LDO regulator 220 as described in FIG. 3.

Figure 7:
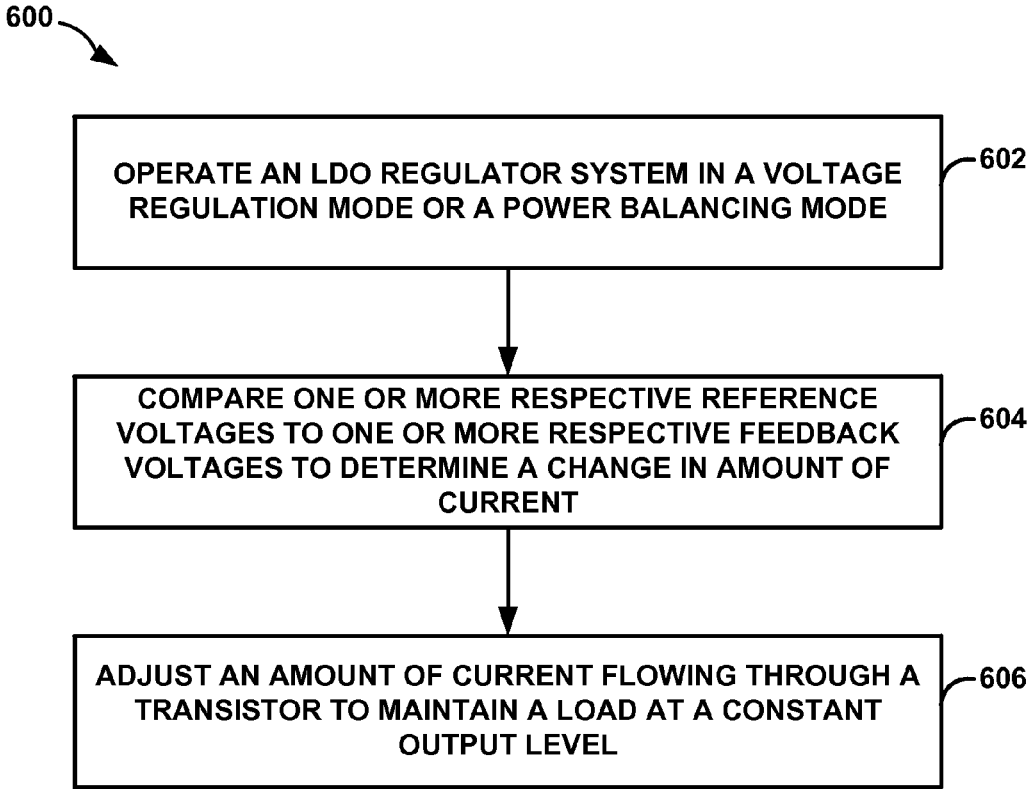
FIG. 7 is a flowchart illustrating an example technique of operating a LDO regulator system in a voltage regulation mode or a power balancing mode, in accordance with this disclosure.

FIG. 7 is a flowchart illustrating an example technique of operating a LDO regulator system in a voltage regulation mode or a power balancing mode, in accordance with this disclosure. For ease of illustration, reference is made to FIG. 1. In the example of FIG. 7, LDO regulator system 1 may operate in one of a voltage regulation mode or a power balancing mode (602).

While operating in either the voltage regulation mode or the power balancing mode, LDO regulator system 1 compares one or more respective reference voltages to one or more respective feedback voltages to determine a change in amount of current that needs to be delivered by LDO regulator system 1, wherein the first reference voltage is across a reference resistor and a first feedback voltage is across a shunt resistor (604). In some examples, LDO regulator system 1 may operate in the voltage regulation mode, and the change in the amount of current that needs to be delivered by LDO regulator system 1 may be based on the comparison of a second reference voltage to a second feedback voltage, and the second reference voltage may be an input and the second feedback voltage may be a voltage proportional to an output voltage across a load. In some examples, LDO regulator system 1 may generate a second current based on the comparison of the second reference voltage to the second feedback voltage with a second amplifier, and the second reference voltage may be an input and the second feedback voltage may be a voltage proportional to an output voltage across a load of LDO regulator system 1. In other examples, LDO regulator system 1 may operate in the power balancing mode, and the change in the amount of current that needs to be delivered by LDO regulator system 1 may be based on the comparison of a first reference voltage to a first feedback voltage, wherein the first reference voltage is across a reference resistor and the first feedback voltage is across a shunt resistor. In some examples, LDO regulator system 1 may operate in either the voltage regulation mode or the power balancing mode, and LDO regulator system 1 may generate a first current based on the comparison of the first reference voltage to the first feedback voltage with a first amplifier.

In response to the change in the amount of current that needs to be delivered by LDO regulator system 1, LDO regulator system 1 may adjust an amount of current flowing through a transistor to maintain a load of LDO regulator system 1 at a constant output voltage level (606). In some examples, when LDO regulator system 1 is operating in the voltage regulation mode, LDO regulator system 1 may be limited in adjusting the amount of current flowing through the transistor to maintain the load at the constant output voltage level, if the first feedback voltage is greater than the first reference voltage. In some examples, LDO regulator system 1 may adjust the amount of current flowing through the transistor to maintain the load at the constant output voltage level by receiving, at an output buffer stage, an amount of current from a combined output of a first and a second amplifier, and generating, by the output buffer stage, a control signal at a gate or a base of the transistor based on the amount of current received at the output buffer stage from the combined output. In some examples, the control signal may be one of a voltage signal if the transistor is a p-channel field effect transistor (PFET) or a current signal if the transistor is a PNP bipolar junction transistor.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware units or software modules. Also, the techniques may be fully implemented in one or more circuits or logic elements.

The techniques of this disclosure may be implemented in a wide variety of devices or apparatuses, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be provided by a collection of interoperative hardware units, including one or more processors as described above, in conjunction with suitable software and/or firmware.

Various illustrative aspects of the disclosure are described above. These and other aspects are within the scope of the following claims.

The invention claimed is:

1. A method comprising:

operating a low-dropout (LDO) regulator system in one of a voltage regulation mode or a power balancing mode, the method of operating the LDO regulator system comprising:

delivering, by a transistor connected to a power source of a LDO linear regulator and a load of the LDO linear regulator, an amount of current needed to maintain an output of the LDO linear regulator at a constant output voltage level;

generating, by a first amplifier stage, a first current proportional to a difference between a first reference voltage and a first feedback voltage, wherein the first reference voltage is across a reference resistor and the first feedback voltage is across a shunt resistor;

generating, by a second amplifier stage, a second current proportional to a difference between a second reference voltage and a second feedback voltage; and in response to generating the first current and the second current, generating, by an output buffer stage connected to a combined output of the first amplifier stage and the second amplifier stage, based on an amount of current at the combined output, a control signal to control the transistor to maintain the load at the constant output voltage level.

2. The method of claim 1, wherein the second reference voltage is an input and the second feedback voltage is a voltage proportional to an output voltage across the load.

3. The method of claim 1, wherein the LDO regulator system is operating in the voltage regulation mode, and wherein the amount of current delivered by the transistor to maintain the load at the constant output voltage level is limited, if the first feedback voltage is greater than the first reference voltage.

4. The method of claim 1, wherein the LDO regulator system is operating in the power balancing mode, the method further comprising:

sinking or sourcing, by the first amplifier stage, the first current; and isolating, by the second amplifier stage, the second current from the combined output.

5. The method of claim 4, wherein sinking or sourcing the first current comprises:

sinking, by a switch of the first amplifier stage, the first current when the first reference voltage is less than the first feedback voltage; and sourcing, by the switch of the first amplifier stage, the first current when the first reference voltage is greater than the first feedback voltage.

6. The method of claim 1, further comprising:

providing, by a separate fully integrated LDO linear regulator, a replication current to a reference stage; and driving, by the reference stage, the transistor to provide a current to the load that mirrors an output current from the separate fully integrated LDO linear to the load.

7. The method of claim 1, wherein the transistor is external to a separate fully integrated LDO linear regulator, and wherein the first and second amplifier stages and the output buffer stage are located internal with the separate fully integrated LDO linear regulator.

8. The method of claim 1, wherein the control signal is a voltage signal for a p-channel field effect transistor (PFET) or a current signal for a PNP bipolar junction transistor.

9. A low-dropout (LDO) regulator system comprising:

a transistor connected to a power source of a low-dropout (LDO) linear regulator and a load of the LDO linear regulator, wherein the transistor delivers an amount of current needed to maintain an output of the LDO linear regulator at a constant output voltage level;

a shunt resistor connected in series with the transistor;

a reference stage, wherein the reference stage includes a reference resistor connected to the power source of the LDO linear regulator and a current source connect to a ground;

a first amplifier stage, wherein the first amplifier stage generates a first current proportional to a difference between a voltage drop across the shunt resistor and a reference voltage across the reference resistor;

a second amplifier stage, wherein the second amplifier stage generates a second current proportional to a difference between a proportional output voltage and a second reference voltage; and an output buffer stage connected between a combined output of the first and second amplifier stages and a gate of the transistor, wherein the output buffer stage generates a control signal to control the transistor based on an output from the combined output;

wherein the first amplifier stage in a voltage regulation mode is configured to sink the first current, wherein the first amplifier stage in a power balancing mode is configured to sink or source the first current, wherein the second amplifier stage in the voltage regulation mode is configured to sink or source the second current, and wherein the second amplifier stage in the power balancing mode is configured to isolate the second current from the combined output.

10. The LDO regulator system of claim 9, further comprising:

a first switch connected to an output of the first amplifier stage; and a second switch connected to an output of the second amplifier stage;

wherein each output of the first switch and the second switch are connected to each other to form the combined output, wherein a first position of the first switch corresponds to the voltage regulation mode of the first amplifier stage, wherein a second position of the first switch corresponds to the power balancing mode of the first amplifier stage, wherein a first position of the second switch corresponds to the voltage regulation mode of the second amplifier stage, and wherein a second position of the second switch corresponds to the power balancing mode of the second amplifier stage.

11. The LDO regulator system of claim 10, further comprising:

a diode, wherein the diode is connected between the first position of the first switch and the combined output, and wherein the diode is configured to allow the first amplifier stage to only sink the first current when the first switch is in the first position.

12. The LDO regulator system of claim 10, wherein the first and second amplifier stages are operating in the power balancing mode, further comprising:

a separate fully integrated drop-out (LDO) linear regulator, wherein the separate fully integrated LDO linear regulator is configured to provide a replication current to the reference stage, and wherein the reference stage is configured to drive the transistor to provide a current to the load that mirrors an output current from the separate fully integrated LDO linear regulator to the load.

13. The LDO regulator system of claim 9, wherein the shunt resistor connects one of a source of the transistor to the power source or a drain of the transistor to the load of the LDO linear regulator.

14. The LDO regulator system of claim 9, wherein the transistor is external to a separate fully integrated low-dropout (LDO) linear regulator, and wherein the reference stage, the first and second amplifier stages, and the output buffer stage are located internal with the separate fully integrated LDO linear regulator.

15. The LDO regulator system of claim 14, wherein the transistor is one of a p-channel field effect transistor (PFET) or a PNP bipolar junction transistor.

16. The LDO regulator system of claim 9, further comprising a bias resistor, wherein the bias resistor enables the output buffer stage to provide a voltage control signal to the gate of the transistor.

17. A device comprising:

means for operating a low-dropout (LDO) regulator system in a voltage regulation mode; and means for operating the LDO regulator system in a power balancing mode, wherein the means for operating the LDO regulator system in the voltage regulation mode and the power balancing mode further comprises:

means for delivering, by a transistor connected to a power source of a LDO linear regulator and a load of the LDO linear regulator, an amount of current needed to maintain an output of an LDO linear regulator at a constant output voltage level;

means for generating, by a first amplifier stage, a first current proportional to a different between a first reference voltage and a first feedback voltage, wherein the first reference voltage is across a reference resistor and the first feedback voltage is across a shunt resistor;

means for generating, by a second amplifier stage, a second current proportional to a difference between a second reference voltage and a second feedback voltage; and in response to generating the first current and the second current, means for generating, by an output buffer stage connected to a combined output of the first amplifier stage and the second amplifier stage, based on an amount of current at the combined output, a control signal to control the transistor to maintain the load at the constant output voltage level.

18. The device of claim 17, wherein the second reference voltage is an input and the second feedback voltage is a voltage proportional to an output voltage across the load.

19. The device of claim 18, wherein the amount of current delivered by the transistor to maintain the load at the constant output voltage level is limited, if the first feedback voltage is greater than the first reference voltage.

20. The device of claim 17, wherein the means for operating the LDO regulator system is operating in the power balancing mode, the device further comprising:

means for sinking or sourcing, by the first amplifier stage, the first current; and means for isolating, by the second amplifier stage, the second current from the combined output.

* * * * *